US006011948A

United States Patent [19]

Amano et al.

[11] Patent Number: 6,011,948

[45] **Date of Patent: *Jan. 4, 2000**

[54] OBLIQUELY TRAVELING SHEET CORRECTING DEVICE AND IMAGE FORMING APPARATUS

[75] Inventors: Masao Amano, Susono; Kazuhide Kudo, Numazu; Toshiharu Kawai, Susono, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/777,605

[22] Filed: Dec. 31, 1996

[30] Foreign Application Priority Data

Jan. 8, 1996 [JP] Japan ..... 8-000509

[51] Int. Cl.[7] ..... G03G 15/00

[52] U.S. Cl. ..... 399/395; 271/245

[58] Field of Search ..... 399/395, 388; 271/243–246, 235, 236, 253, 255

[56] References Cited

U.S. PATENT DOCUMENTS

| | | | |
|---|---|---|---|
| 3,022,998 | 2/1962 | Patalon . | |
| 3,186,325 | 6/1965 | Belder . | |
| 3,281,144 | 10/1966 | Turner et al. . | |
| 3,572,693 | 3/1971 | Larson . | |
| 3,761,075 | 9/1973 | Van Namen . | |
| 3,914,041 | 10/1975 | Opravil | 399/316 |
| 4,025,187 | 5/1977 | Taylor et al. | 399/394 |
| 4,844,443 | 7/1989 | Trafton | 271/245 |
| 4,958,199 | 9/1990 | Yamashita et al. | 399/394 |
| 5,074,545 | 12/1991 | Handa | 271/227 |
| 5,233,400 | 8/1993 | Cahill | 399/395 |

FOREIGN PATENT DOCUMENTS

| | | |
|---|---|---|
| 64-87453 | 3/1989 | Japan . |
| 2-18029 | 5/1990 | Japan . |

*Primary Examiner*—Robert Beatty
*Attorney, Agent, or Firm*—Fitzpatrick, Cella, Harper & Scinto

[57] ABSTRACT

In an obliquely traveling sheet correcting device with a simple arrangement capable of reducing the cost and size thereof and enhancing an obliquely traveling sheet correcting accuracy. Stopping members 15 are turnably disposed to the rotary shaft 18 of free conveyer rollers 13 constituting a pair of conveyer roller 13, 14, the leading edge of a sheet S conveyed by a pair of conveyer rollers 5 is stopped by being abutted against the collision surfaces 20*a* of the stopping members 15, the stopping members 15 are turned and retracted when the sheet forms a predetermined loop to permit the sheet S to pass therethrough. There is also provided an image forming apparatus provided with the obliquely traveling sheet correcting device.

48 Claims, 21 Drawing Sheets

OBLIQUELY TRAVELING SHEET CORRECTING DEVICE AND IMAGE FORMING APPARATUS

BACKGROUND OF THE INVENTION

1. Field of the Invention

The present invention relates to an image forming apparatus provided with an obliquely traveling sheet correcting device.

2. Description of the Related Art

In general, a position where an image is recorded with respect to the position of a sheet (hereinafter, referred to as "recording accuracy") is an important element of image quality in image forming apparatuses. Therefore, there are proposed various types of obliquely traveling sheet correcting means for enhancing the recording accuracy of conventional image forming apparatuses.

For example, there is widely employed an obliquely traveling sheet correcting device of a resist roller system which is arranged such that a pair of resist rollers are disposed in the direction perpendicular to a sheet conveying direction at a position nearest to an image forming unit upstream in the sheet conveying direction (hereinafter, simply referred to as "upstream") and the oblique travel of a sheet is corrected by causing the leading edge of the sheet to be abutted against the nip portion between the pair of resist rollers.

An example of a conventional image forming apparatus provided with an obliquely traveling sheet correcting device using the resist roller system will be described using FIG. 21. In FIG. 21, the leading edge of a sheet S fed from a sheet cassette 100 to a feed roller 101 is abutted against the nip portion between a pair of resist rollers 102 which have previously been stopped by a clutch or the like and the sheet S forms a curved loop as shown in FIG. 21 by the further rotation of the feed roller 101, whereby the oblique travel of the sheet is corrected by the stiffness of the sheet itself.

A resist sensor 103 is disposed upstream of the pair of resist rollers 102 in the vicinity thereof. After the leading edge of the sheet S is detected by the resist sensor 103, the pair of resist rollers 102 are rotated to cause a photoreceptor drum 105 disposed in a process cartridge 104 to convey the sheet S to a confronting image forming unit at a timing at which a predetermined period of time, during which the sheet S forms the loop and the oblique travel thereof is corrected as described above, has elapsed.

In the above prior art, however, the pair of resist rollers 102 and the feed roller 101 must be driven in rotation at a predetermined timing to cause the sheet S to form a predetermined loop between the pair of resist rollers 102 and the feed roller 101. As a result, a drive control system for them is complex and requires a high degree of control accuracy. Thus, a countermeasure such as the provision of a high performance clutch with a gear train is required.

Further, the pair of resist rollers 102 must be composed of a metal roller or the like having a low frictional resistance to reduce the frictional resistance made when the sheet S enters the nip portion between the pair of resist rollers 102. However, when the pair of resist rollers 102 are composed of metal, a pressurizing mechanism must be provided with the pair of resist rollers 102 to compensate for the insufficient conveying force of the sheet S. Since the pressurizing mechanism is relatively expensive and increases an occupying space in the device, there is the problem of the size of the device being increased as well as the cost thereof is made expensive.

SUMMARY OF THE INVENTION

The present invention solves the above problems by providing a sheet oblique travel correcting device which has a simple arrangement, reduces the cost and size of the device and enhances a sheet oblique travel correcting accuracy, and by providing an image forming apparatus provided with such an obliquely traveling sheet correcting device.

In accordance with these objects there is provided an obliquely traveling sheet correcting device comprising a first sheet conveyor means for conveying a sheet and second sheet conveyor means disposed downstream of the first sheet conveyor means for conveying the sheet. Stopping means disposed upstream to and in the vicinity of the second sheet conveyor means are provided for abutting against the leading edge of the sheet conveyed by the first conveyor means to thereby stop the leading edge of the sheet, the stopping means swinging between a position of a first attitude where it abutts against the leading edge of the sheet and a position of second attitude where it permits the sheet to pass therethrough. Urging means are also provided for urging the stopping means to the position of the first attitude.

It is preferable that the second sheet conveyer means is composed of a sheet conveyer rotary body and the locking means is arranged to be able to swing about the center of rotation of the sheet conveyer rotary body.

It is preferable that a space having a shape corresponding to the shape of a loop formed by the sheet from the action of the stopping means be provided on the sheet conveyer passage between the first sheet conveyer means and the second sheet conveyer means or that a sheet guide having a shape corresponding to the shape of a loop which is formed by the sheet be provided and a flapper member or an elastic member be disposed at a position corresponding to the sheet guide for assisting the formation of the loop of the sheet.

It is also preferable that the abutting surface of the stopping means to be abutted against the leading edge of the sheet be composed of an arc surface having a predetermined radius or of a curved surface with an R surface made to the end thereof. Further, it is preferable that a plurality of the abutting surfaces of the stopping means to be abutted against the leading edge of the sheet be provided in the direction perpendicular to the sheet conveying direction. In addition, it is preferable that a reaction force to be acted on the sheet by the stopping means is composed of a gravity balance acting on the stopping means.

Since the present invention is arranged as described above, the urging means exhibits an urging force causing the leading edge of the sheet to be guided by the abutting surface of the locking means to be abutted against the leading edge of the sheet, and the leading edge of the sheet conveyed by the first conveyer means is stopped by the stopping means and oblique travel of the sheet is corrected by the stiffness of the sheet itself through the loop formed by the sheet.

When the stiffness of the sheet which is in the state that it cannot escape anywhere acts on the stopping means, the stiffness of the sheet is greater than the urging force of the urging means for urging the stopping means. Since the stiffness is greater than the urging force, the sheet swings and retracts the locking means while the leading edge of the sheet is guided by the abutting surface of the stopping means against which the leading edge thereof is abutted, so that the sheet is conveyed by the second conveyer means passing through the stopping means.

It is preferable that the second sheet conveyer means is composed of a sheet conveyer rotary body and the locking means is arranged to swing about the center of rotation of the sheet conveyer rotary body, because the alignment accuracy of the stopping means with the second conveyer means is enhanced by the arrangement.

When a sheet conveying velocity is changed by a conveying resistance and the tolerance of the parts constituting the conveyer rollers and the like which exist upstream of the stopping means, the sheet may swing and retract to stopping means without forming a loop and the conveyer rollers cannot exhibit a force which causes the sheet to pass through the stopping means. In such a case, the difference of the sheet conveying velocity can be absorbed on the upstream side in such a manner that the sheet is forced to form a predetermined loop by the space, the flapper member, the elastic member or the like disposed upstream of the stopping means to thereby exhibit predetermined stiffness.

The leading edge of the sheet can be prevented from being damaged when the leading edge of thereof is abutted against the stopping means by forming the abutting surface of the stopping means to the arc surface having the predetermined radius or the curved surface with the R surface made to the end thereof. Further, no trace of swing of the sheet is partially formed to the stopping means by the provision of a plurality of the abutting surfaces of the stopping means to be abutted against the leading edge of the sheet in the direction perpendicular to the sheet conveying direction.

Further, the abutting resistance acting on the sheet by the stopping means is necessary until the sheet corrects the oblique travel by the stiffness of the sheet itself, whereas it is advantageous that the abutting resistance is smaller to convey the sheet after the leading edge of the sheet passes through the stopping means. Therefore, the abutting resistance to be acted on the sheet is composed of the moment resulting from the dead weight of the stopping means itself, so that the abutting resistance acting on the sheet by the stopping means can be gradually reduced.

BRIEF DESCRIPTION OF THE DRAWINGS

FIGS. 15 and 15A are a cross sectional view showing the arrangement of the image forming apparatus provided with the obliquely traveling sheet correcting device of a sixth embodiment;

DESCRIPTION OF THE PREFERRED EMBODIMENT

Figure 1:
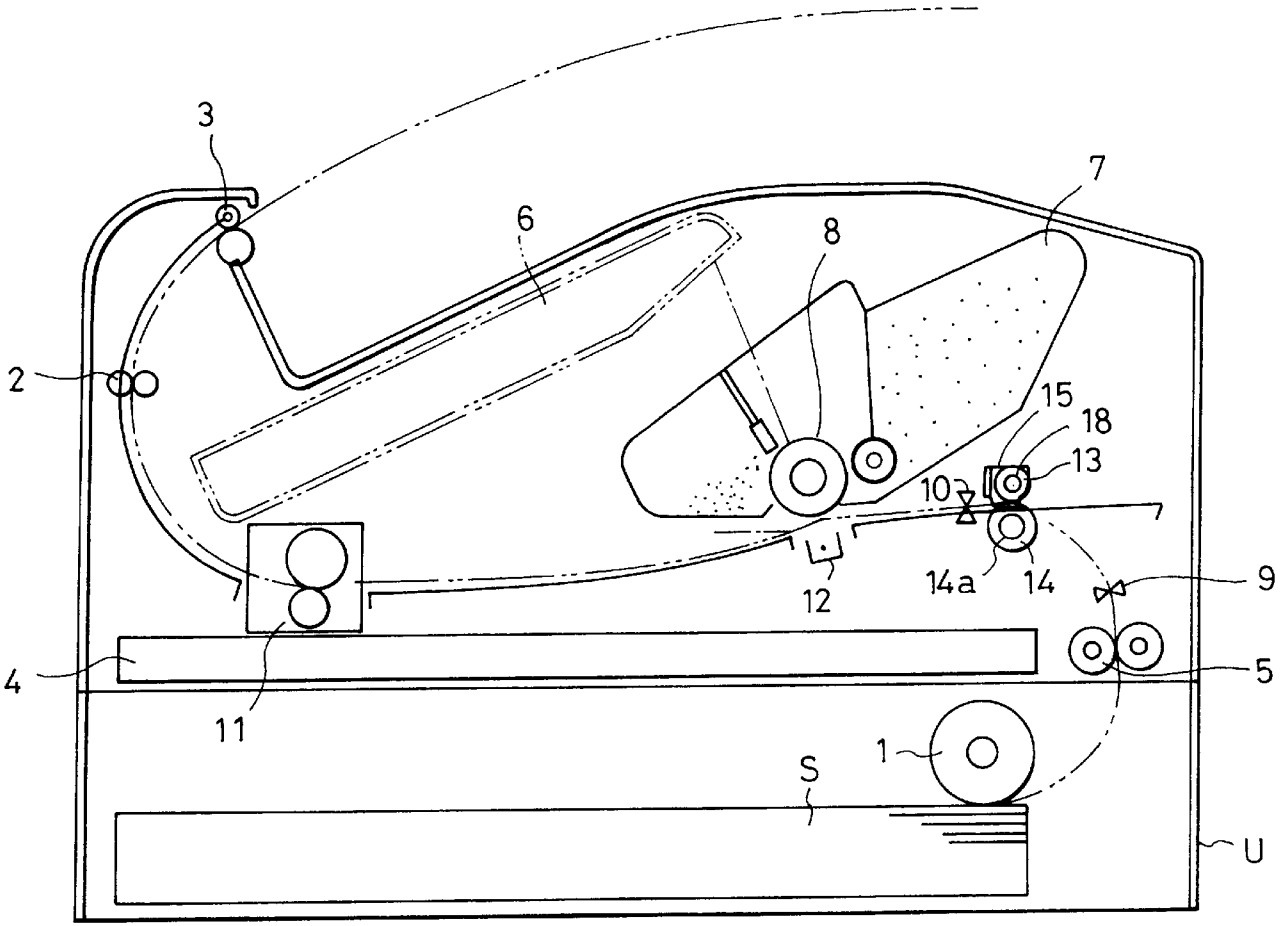
FIG. 1 is a cross sectional view illustrating a first embodiment of an obliquely traveling sheet correcting device according to the present invention and an image forming apparatus provided with the obliquely traveling sheet correcting device.
Figure 2:
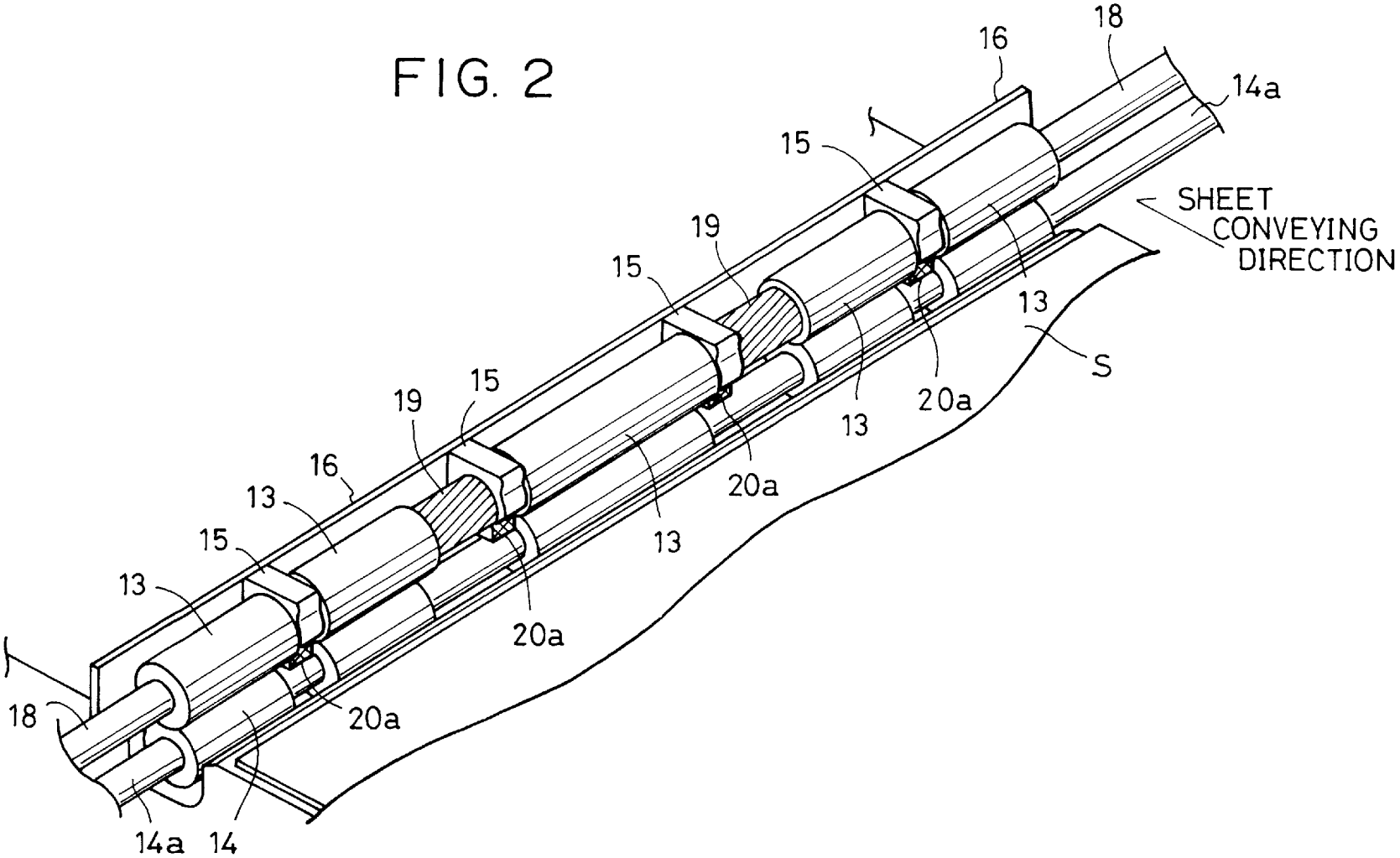
FIG. 2 is a perspective view showing the arrangement of the obliquely traveling sheet correcting device of the first embodiment.
Figure 3:
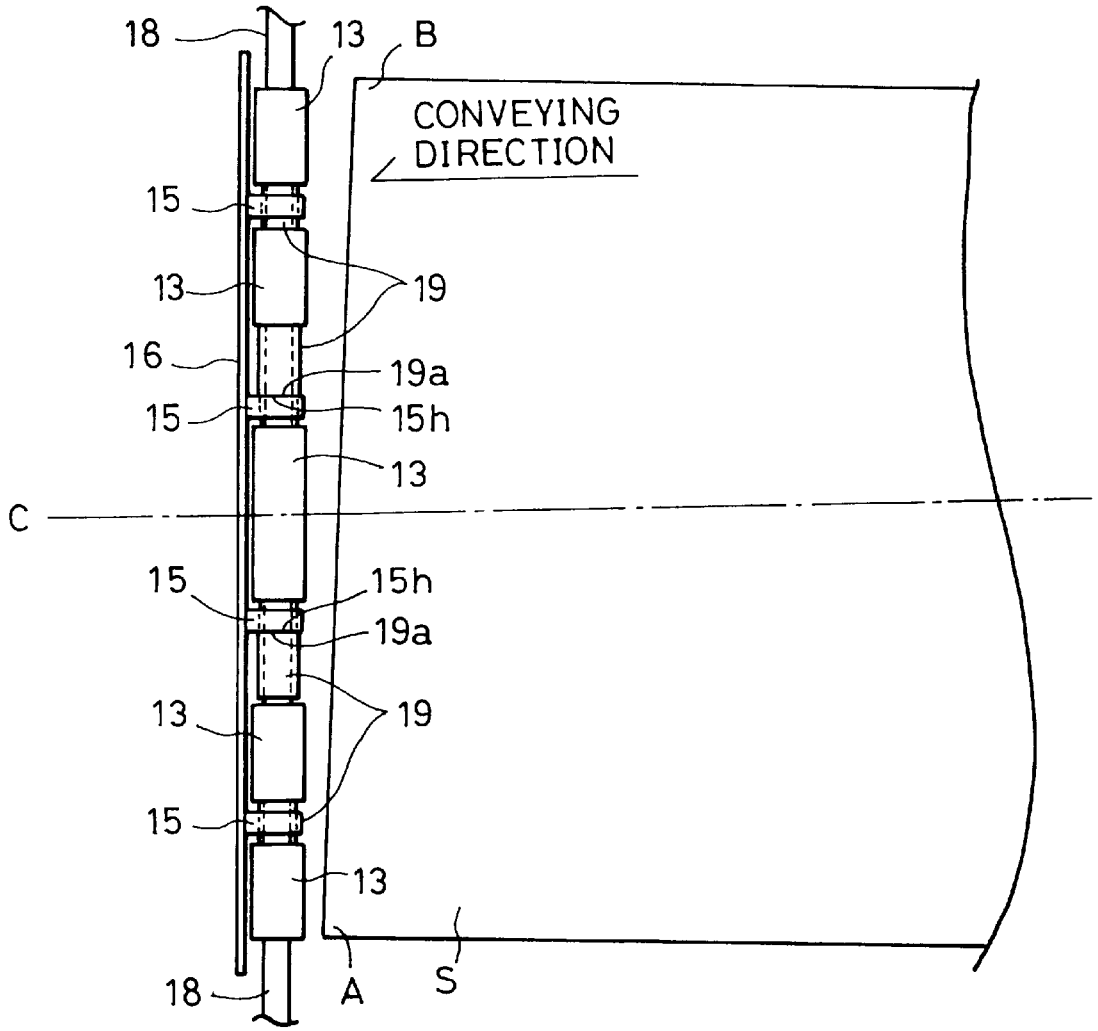
FIG. 3 is a plan view showing the arrangement of the obliquely traveling sheet correcting device of the first embodiment.
Figure 4:
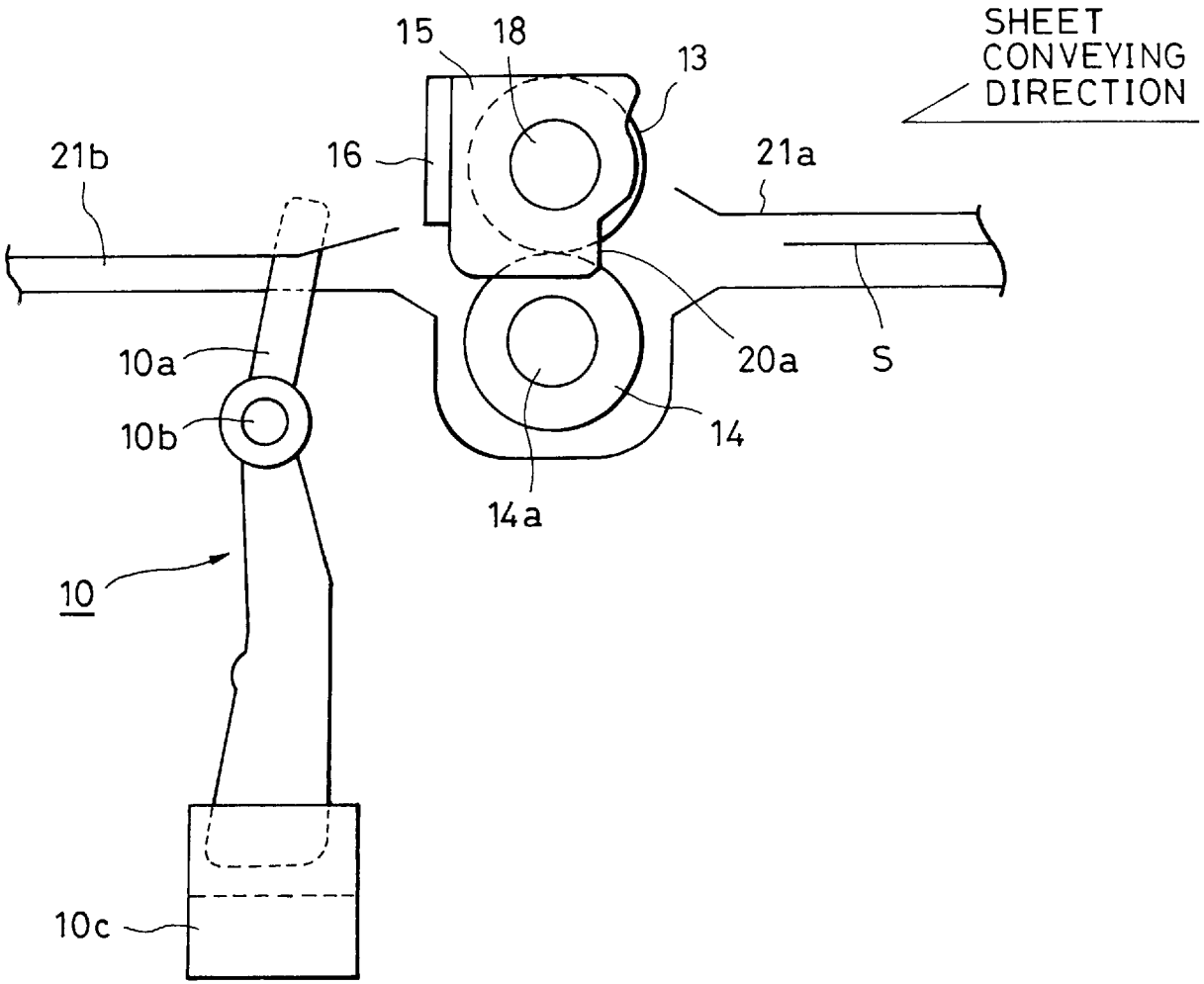
FIG. 4 is a view illustrating the operation of the obliquely traveling sheet correcting device of the first embodiment.
Figure 5:
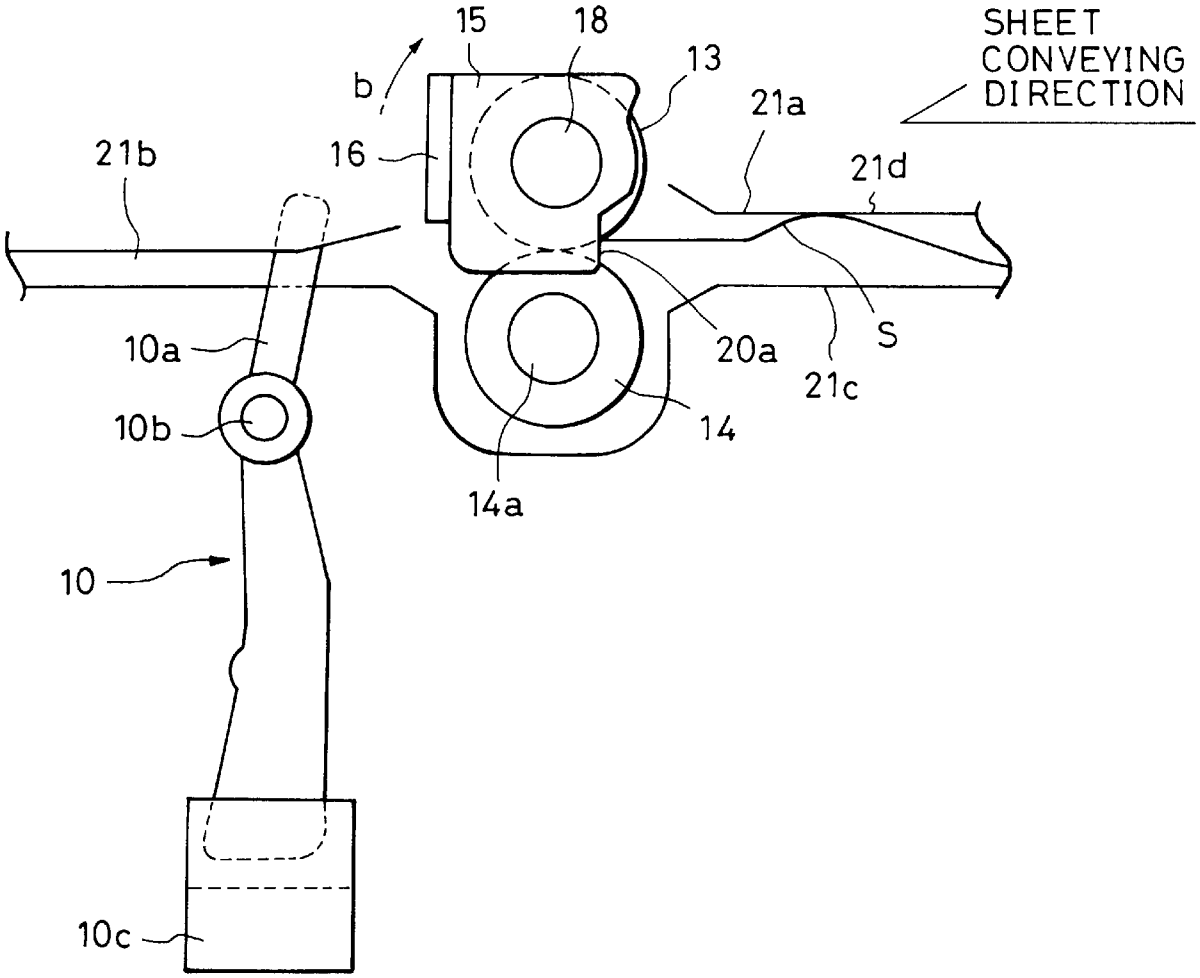
FIG. 5 is a view illustrating the operation of the obliquely traveling sheet correcting device of the first embodiment.
Figure 6:
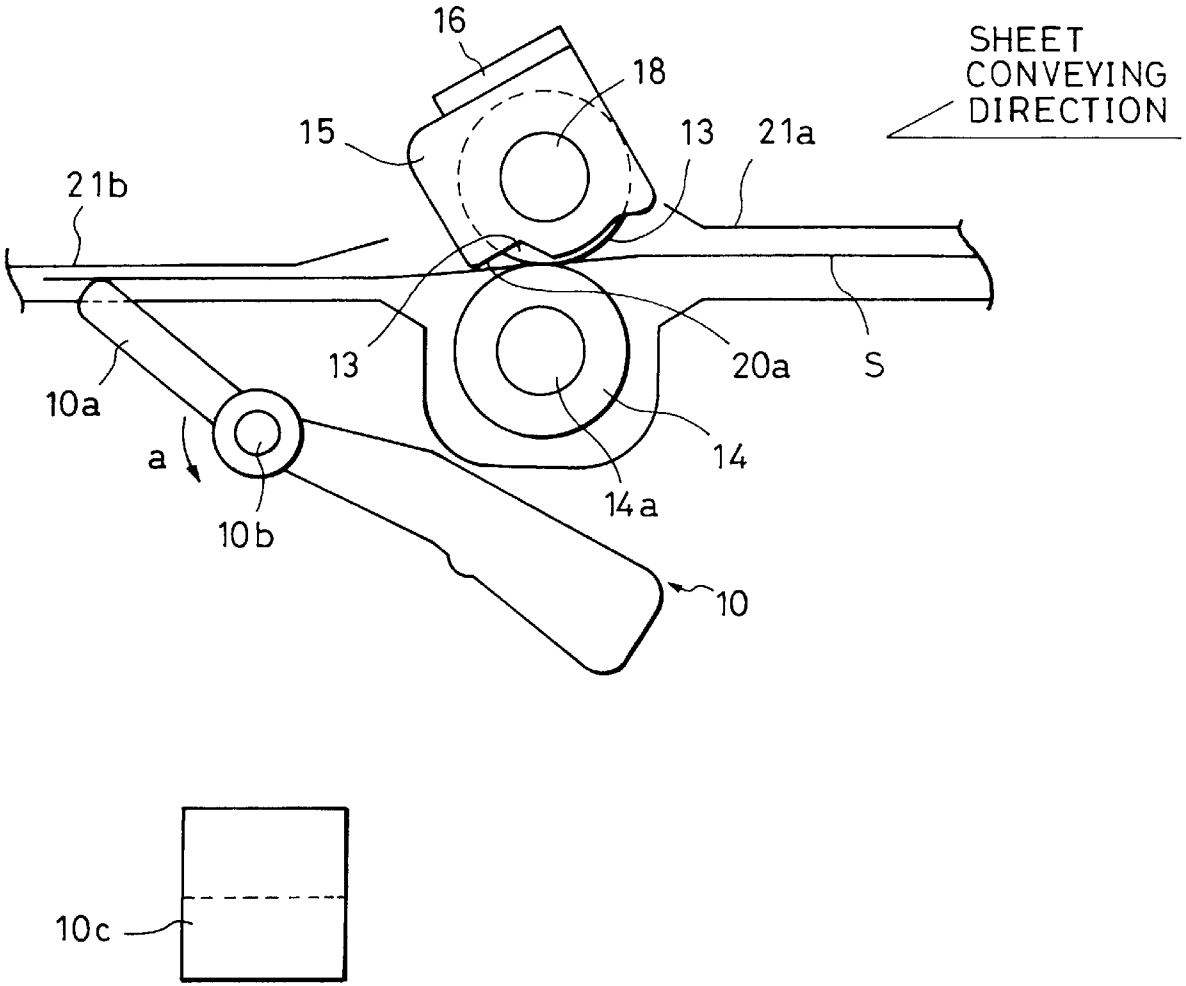
FIG. 6 is a view illustrating the operation of the obliquely traveling sheet correcting device of the first embodiment.
Figure 7:
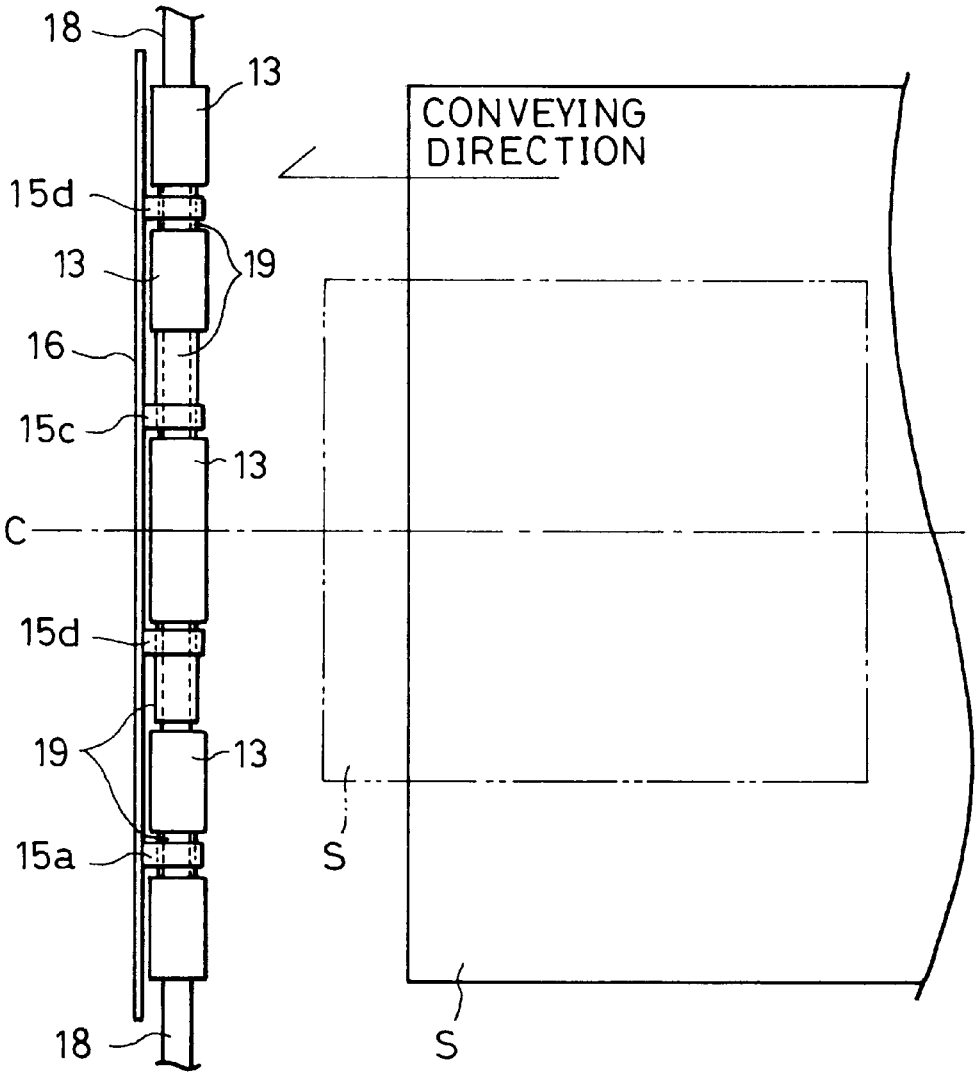
FIG. 7 is a plan view illustrating how the obliquely traveling sheet correcting device of the first embodiment operates with a different sheet width.

An embodiment of an obliquely traveling sheet correcting device according to the present invention and an image forming apparatus provided with the obliquely traveling sheet correcting device will be specifically described with reference to the drawings. FIG. 1 is a cross sectional view describing the first embodiment of the obliquely traveling sheet correcting device according to the present invention and the image forming apparatus provided with the obliquely traveling sheet correcting device, FIG. 2 is a perspective view showing the arrangement of the obliquely traveling sheet correcting device of the first embodiment, FIG. 3 is a plan view showing the arrangement of the obliquely traveling sheet correcting device of the first embodiment, FIG. 4 to FIG. 6 are views describing operation of the obliquely traveling sheet correcting device of the first embodiment, and FIG. 7 is a plan view describing how the obliquely traveling sheet correcting device of the first embodiment cope with a different sheet width.

First, the entire arrangement of the obliquely traveling sheet correcting device according to the present invention and the image forming apparatus provided with the obliquely traveling sheet correcting device will be described with reference to FIG. 1. Sheets S composed of paper, synthetic resin or the like accommodated in a feed unit U are drawn out by a feed roller 1 and fed while being separated one by one by a separator (not shown).

Each of the sheets S fed by the feed roller 1 is conveyed by a pair of conveyer rollers 5 as first sheet conveyer means and further conveyed by a pair of conveyer rollers 13, 14 as a sheet conveyer rotary body acting as second sheet conveyer means which is disposed at a position downstream of a sheet conveying direction (hereinafter, simply referred to as "downstream"), so that the sheet S is introduced to an image forming unit which is confronted by a photoreceptor drum 8 as an image carrier rotary body composed of an electrophotographic photoreceptor and disposed in a process cartridge 7.

On the other hand, a laser scanner 6 controlled by a control unit 4 forms a latent image on the photoreceptor drum 8 the surface of which is uniformly charged by an electrizer by scanning a laser beam according to image information. Then, a toner image is formed to the latent image by a developing unit provided with the process cartridge 7.

The sheet S is conveyed between the photoreceptor drum 8 and an image transfer electrizer 12 in synchronism with the rotation of the photoreceptor drum 8, and the toner image formed on the photoreceptor drum 8 by the image transfer electrizer 12 is transferred to the sheet S. The sheet S to which the image is transferred is conveyed to a fixing unit 11, and after the toner image is fixed to the sheet S by heat and pressure from the fixing unit 11, the sheet is discharged to the outside of the apparatus by pairs of discharge rollers 2, 3.

Sensors 9, 10, which act as sheet sensing means, are respectively disposed between the pair of conveyer rollers 5 and the pair of conveyer rollers 13, 14, and downstream of the pair of conveyer rollers 13, 14 in the vicinity thereof and upstream of the photoreceptor drum 8 in a sheet conveying direction (hereinafter, simply referred to as "upstream"), and an obliquely traveling sheet correcting device, which is shown in FIG. 2 to FIG. 7 and will be described later in detail, is provided with the pair of conveyer rollers 13, 14.

As shown in FIG. 4 to FIG. 6, the sensor 10 is disposed downstream but in the vicinity of the pair of conveyer rollers 13, 14, and a sensor flag 10*a* which is turnable about a shaft 10*b* is disposed such that one end of the sensor flag 10*a* projects through a sheet conveyer passage 21*b* disposed downstream of the pair of conveyer rollers 13, 14 in a first state when the sheet S does not pass therethrough. The other end of the sensor flag 10*a* can turn to the position of the first state where it shuts off the light passage of a sensing unit 10*c* composed of a photosensor (see FIG. 4 and FIG. 5) and to the position of a second state where the sheet S is engaged with one end of the sensor flag 10*a* projecting to the sheet conveyer passage 21*b* and turns the sensor flag 10*a* in the direction of the arrow a of FIG. 6 about the shaft 10*b* to cause the other end of the sensor flag 10*a* to open the light passage of the sensing unit 10*c* (see FIG. 6).

Next, the arrangement of the first embodiment of the obliquely traveling sheet correcting device which is a feature of the present invention will be described using FIG. 2 to FIG. 7. As shown in FIG. 2, the pair of conveyer rollers 13, 14, which are disposed such that the rotational axes thereof are parallel with the direction of the rotational axis of the photoreceptor drum 8, are subdivided into a plurality of sections in a direction perpendicular to a sheet conveying direction. That is, the conveyer roller 14 is composed of a plurality of the subdivided conveyer rollers 14 which are securely fixed to a rotary shaft 14*a* and rotated integrally therewith and the conveyer roller 13 is composed of a plurality of subdivided free rollers 13 inopposing relation to the conveyer rollers 14. The free conveyer rollers 13 are fixed to a rotary shaft 18 which is journaled by a not shown main body frame and act as a sheet conveyer rotary body.

A plurality of auxiliary free rollers 19 each having an outside diameter smaller than that of the free conveyer rollers 13 are rotatably engaged with the rotary shaft 18, to which the free conveyer rollers 13 are fixed in the direction of the rotary shaft 18, and are positioned between the free conveyer rollers 13. Further, each of a plurality of shutter members 15 which serve as stopping members, and which are integrally connected to one another by a connecting member 16, is turnably engaged with each of the auxiliary free rollers 19 on the outer periphery threreof.

As shown in FIG. 3, the sheet S is conveyed using the center thereof as a conveying reference and the shutter members 15 are aligned with the free conveyer rollers 13 by the auxiliary free rollers 19 in such a manner that the shutter member regulating surfaces 19*a* of the auxiliary free rollers 19 disposed on both the sides of the free conveyer rollers 13 disposed at a center C is abutted against and slides on the abutting surfaces 15*h* of the shutter members 15 engaged with the auxiliary free rollers 19.

With the above arrangement, since the shutter member 15 is not in contact with the free conveyer roller 13 in the direction of the rotary shaft 18, the free conveyer roller 13 and the shutter member 15 can turn independently of each other. Therefore, the turning motion of the shutter member 15 is not prevented by the free conveyer roller 13 which comes into contact with the shutter member 15.

Although this embodiment is arranged by using the auxiliary free roller 19 to separate free conveyer roller 13 from shutter member 15, it may be arranged by regulating the position of the shutter member 15 in the direction of the rotary shaft 18 by, for example, an E type stop ring (so-called E ring) or the like.

The plurality of shutter members 15 can swing about the rotary shaft 18 between the position of a first attitude where the collision surfaces 20*a* of the shutter members 15 are abutted against the leading edge of the sheet S conveyed by the plurality of conveyer rollers 5 and can lock the leading edge thereof (see FIG. 4, FIG. 5) and the position of a second attitude where the sheet S is permitted to pass through the shutter members 15 (see FIG. 6) and the phases of the turning motion of the respective shutter members 15 about the rotary shaft 18 are caused to coincide with one another by the connecting member 16.

The shutter members 15 maintain the first attitude shown in FIG. 2 and FIGS. 4 and 5 at all times by the gravity of the shutter members 15 and the connecting member 16 acting thereon.

That is, in this embodiment, urging means for urging the shutter members 15 to the position of the first attitude makes use of the torque which is conveyed to the shutter members 15 by the gravity resulting from the dead weight of the connecting member 16 for connecting the shutter members 15 with respect to the rotary shaft 18 as the center of turn of the connecting member 16.

The shutter members 15 are provided with the collision surfaces 20*a* which act as sheet leading edge collision surfaces which can lock the sheet S by abutting against the leading edge thereof just before the sheet S enters the nip portion between the conveyer rollers 14 and the free conveyer rollers 13. When the shutter members 15 are located at the position of the first attitude, the collision surfaces 20*a* of the shutter members 15 are located upstream of the nip portion between the conveyer rollers 14 and the free conveyer rollers 13.

Note, although the plurality of shutter members 15 are connected by the connecting member 16 in the first embodiment, the shutter members 15 may alternatively be integrally formed with the connecting member 16.

When the sheet S is conveyed by the pair of conveyer rollers 5 and, for example, obliquely enters the pair of conveyer rollers 13, 14 as shown in FIG. 3, the sheet S reaches the image forming unit while being conveyed in the oblique attitude in the absence of the shutter members 15 and the connecting member 16, thus an image transferred to the sheet S is recorded obliquely with respect to the sheet S.

In the first embodiment, however, since the shutter members 15 and the connecting member 16 are arranged as described above and provided with the pair of conveyer rollers 13, 14, the oblique travel of the sheet S can be corrected by an action to be described later.

First, the leading edge of the sheet S on the advancing side thereof (lower side in FIG. 3) is abutted against the collision surfaces 20*a* of the shutter members 15 disposed at the positions corresponding to the leading edge. At this timing, the leading edge of the sheet S cannot push and turn the shutter members 15 against the gravity acting thereon by the dead weight of the connecting member 16.

When the sheet S is further conveyed by the pair of conveyer rollers 5, the leading edge A of the sheet S on the advancing side thereof is stopped in the state that the leading edge A is abutted against the collision surfaces 20*a* of the shutter members 15 and the leading edge B of the sheet S on the trailing side thereof are stopped by being sequentially abutted against the collision surfaces 20*a* of the shutter members 15 which are disposed at the positions corresponding to the leading edge B. When the sheet S is further conveyed by the pair of conveyer rollers 5, the sheet S forms a curved loop as shown in FIG. 5, so that the oblique travel of the sheet S is corrected by the action of the stiffness of the sheet S itself so that the leading edge thereof is made parallel with the direction of the rotational axis of the pair of conveyer rollers 13, 14.

Then, the sheet S forms a predetermined loop in the sheet conveyer passage 21*a* disposed upstream of the pair of conveyer rollers 13, 14 in the vicinity thereof as shown in FIG. 5. When the loop portion of the sheet S is abutted against the guide member 21*d* or 21*c* constituting the sheet conveyer passage 21*a* to thereby regulate the further increase of the loop, a force for turning the shutter members 15 about the rotary shaft 18 in the direction of the arrow b in FIG. 5 and retracting the same is produced for the first time by the stiffness of the sheet S. The leading edge of the sheet S enters the nip portion between the conveyer rollers 14 and the free conveyer rollers 13 while abutting and pushing against the shutter members 15.

When the sheet S is conveyed while being clamped by the nip portion between the conveyer rollers 14 and the free conveyer rollers 13, the shutter members 15 are pushed away by the sheet S and moved to a retracting position as shown in FIG. 6.

The leading edge of the sheet S advances in the state that it is abutted against the shutter members 15 at least until it is clamped by the nip portion between the conveyer rollers 14 and the free conveyer rollers 13. With this operation, since the sheet S is clamped by the nip portion between the conveyer rollers 14 and the free conveyer rollers 13 in the state that the oblique travel thereof is corrected, the oblique travel corrected state is maintained even if shutter members 15 retract.

Then, since the sheet S is engaged with the sensor flag 10*a* of the sensor 10 disposed downstream of the pair of conveyer rollers 13, 14 in the vicinity thereof to thereby turn the sensor flag 10*a* about the shaft 10*b* in the direction of the arrow a of FIG. 6 and open the light passage of the sensing unit 10*c*, the sensor 10 detects that the sheet S has passed.

When the sensor 10 detects the sheet S, the laser scanner 6 forms a latent image on the surface of the photoreceptor drum 8, a toner image is formed on the photoreceptor drum 8 by a series of processing operation effected by the process cartridge 7 and the toner image which is formed on the surface of the photoreceptor drum 8 is transferred to the sheet S conveyed in synchronism with the rotational motion of the photoreceptor drum 8.

Since the sensor flag 10*a* actuates the sensing unit 10*c* so as to start the image forming operation of the image forming means in response to the information detected by the sensing unit 10*c* as described above, a timing at which an image is formed can be maintained constant regardless of a period of time necessary for the sheet S to pass through the shutter members 15. That is, even if the period of time during which the sheet S passes through the shutter members 15 is different in correspondence to various types of the sheet S having different stiffness, the timing at which the image is formed can be maintained constant.

Since the leading edge of the sheet S is parallel to the rotational axis of the pair of conveyer rollers 13, 14 at the time by the above oblique travel correcting operation, when a sufficient conveying force is applied to the sheet S by the pair of conveyer rollers 13, 14, the sheet S can be conveyed to the photoreceptor drum 8 without traveling obliquely, so that the image to be transferred to the sheet S can be recorded without inclining with respect to the sheet S.

The length of the sheet S being used in the direction perpendicular to the sheet conveying direction (hereinafter, referred to as "width of sheet S") is relatively large as shown in FIG. 7 (the sheet S is shown by the solid line in FIG. 7), the oblique travel of the sheet S is corrected mainly by the two shutter members 15*a*, 15*d* which are disposed corresponding to both the side edges of the sheet S in the vicinity thereof to act on the leading edge of the sheet S as described above.

Further, when the width of the sheet S being used is relatively small and cannot be caught by the shutter members 15*a* and 15*d* (the sheet S shown by the two-dot-and-dash line in FIG. 7), the oblique travel of the sheet S is corrected by the shutter members 15*b*, 15*c* which are located to the center side with respect to the shutter members 15*a*, 15*d*.

When the intervals between the plurality of shutter members 15 corresponding to the width of the sheet S are set as large as possible, the error of correcting angle of the leading edge of the sheet S with respect to the direction of the rotational axis of the pair of conveyer rollers 13, 14 is reduced. Thus, although it is preferable to dispose the shutter members 15 in the vicinity of both the side edges of the sheet S being conveyed to obtain an oblique travel correcting capability of pinpoint accuracy to the sheet S, it is also preferable to provide the plurality of shutter members 15 by disposing them in the vicinity of the center of conveyance C of the sheet S so that the oblique travel of the sheet S having a relatively small width can be corrected.

It is preferable to make the intervals of the two shutter members 15*b*, 15*c* nearest to the center C of the conveyer passage of the sheet S on both the sides thereof smaller than the minimum width of the sheet S to be used to the image forming apparatus.

The oblique travel correcting effect to the sheet S can be maintained in such a manner that the sheet S is conveyed by being clamped between the nip portion between the conveyer rollers 14 and the free conveyer rollers 13 just after the oblique travel of the sheet S is corrected by the shutter members 15. This correcting operation is realized by that the distance between the collision surfaces 20*a* of the shutter members 15 and the nip portion between the conveyer rollers 14 and the free conveyer rollers 13 is minimized in a possible range as shown in this embodiment and the leading edge of the sheet S is locked by being abutted against the collision surfaces 20*a* just before the leading edge of the sheet S, which entered the nip portion between the conveyer rollers 14 and the free conveyer rollers 13, is clamped by the nip portion.

Although the urging means for urging the shutter members 15 to the position of the first attitude is arranged by using the gravity balance acting on the dead weight of the connecting member 16, this arrangement is advantageous because it is simple in construction and also because when the shutter members 15 are turned by being pushed by the sheet S and the sheet S passes through the shutter members 15, the urging resistance from the shutter members 15 to the sheet S is not increased.

In particular, since the gravitational force exerted on shutter members 15 by the connecting member 16 are set in this case so that when the shutter members 15 are swung by being pushed by the sheet S, the reaction force which the sheet S receives from the shutter members 15 is made weaker than the reaction force which the sheet S receives from the shutter members 15 when the leading edge of the sheet S is abutted against the shutter members 15 for the first time, the sheet S is liable to pass through the shutter members 15 by turning and retracting them. This arrangement is preferable because the occurrence of a jam is prevented. That is, since a gravity vector acting on the center of gravity of the shutter members 15 and the connecting member 16 as a whole approaches the rotary shaft 18 as the shutter members 15 turn clockwise, a counterclockwise moment is made weak, thus the reaction force to the sheet is also made weak.

Further, the oblique travel of the sheet S having various types of stiffness can be corrected by changing the weight of the connecting member 16 in correspondence to the stiffness of various types of the sheet S.

Although the shutter members 15 and the connecting member 16 are arranged to turn about the rotational axis of the free conveyer rollers 13 in this embodiment, they may be arranged to turn about the rotary shaft 14*a* of the conveyer rollers 14.

Figure 8A:
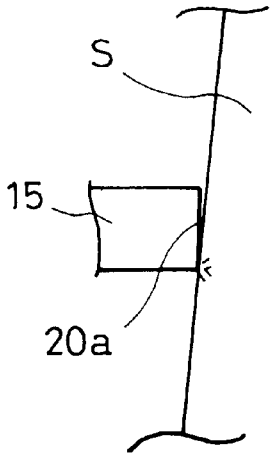
FIG. 8(*a*) is a horizontal cross sectional view showing the outside shape of the collision surface of a shutter member of the first embodiment and FIG. 8(*b*) is a horizontal cross sectional view showing the outside shape of the collision surface of the shutter member of a second embodiment.
Figure 8B:
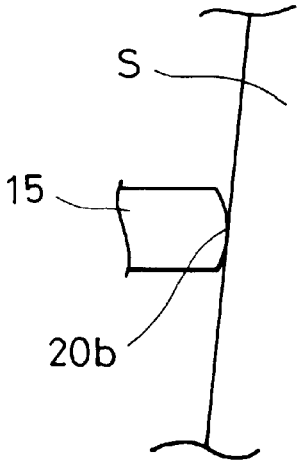

Next, a second embodiment of the obliquely traveling sheet correcting device according to the present invention and the image forming apparatus provided with the obliquely traveling sheet correcting device will be described using FIG. 8(*a*) and FIG. 8(*b*). FIG. 8(*a*) is a horizontal cross sectional view showing the outside shape of the collision surface 20*a* of the shutter member of the first embodiment and FIG. 8(*b*) is a horizontal cross sectional view showing the outside shape of the collision surface 20*b* of the shutter member of the second embodiment. Note, components arranged similarly to those of the first embodiment are denoted by the same numerals and the description thereof is omitted.

Since the collision surface 20*a* of the shutter member 15 formes a plane in the first embodiment as shown in FIG. 8(*a*), the edge of the collision surface 20*a* is made to a corner. Thus there is a possibility that when the leading edge of a sheet S is abutted against the corner, the leading edge of the sheet S will be damaged by it.

To prevent the above drawback, the second embodiment is arranged such that the collision surface 20*b* of the shutter member 15 has an arc shaped surface having a predetermined radius or a curve surface with an R surface at a corner as shown in FIG. 8(*b*). As a result, when the sheet S is conveyed obliquely and the leading edge of the sheet S is abutted against the collision surface 20*b* of the shutter member 15, the leading edge is not abutted against a corner contrary to the first embodiment, thus the leading edge of the sheet S is not damaged.

Since the R surface or the arc surface of the collision surface 20*b* is formed to have a predetermined curvature so that when the sheet S achieves the maximum oblique travel supposed by the obliquely traveling sheet correcting device, the leading edge of the sheet S is not abutted against the curvature changing portion at the boundary between both the side edges of the collision surface 20*b* and the R surface or the arc surface, a sheet oblique travel correcting capability is compatible with a damage preventing effect to the sheet S in an optimum state. The other aspects of the second embodiment are similar to that of the first embodiment and advantages similar to that of the first embodiment can be obtained.

Figure 9:
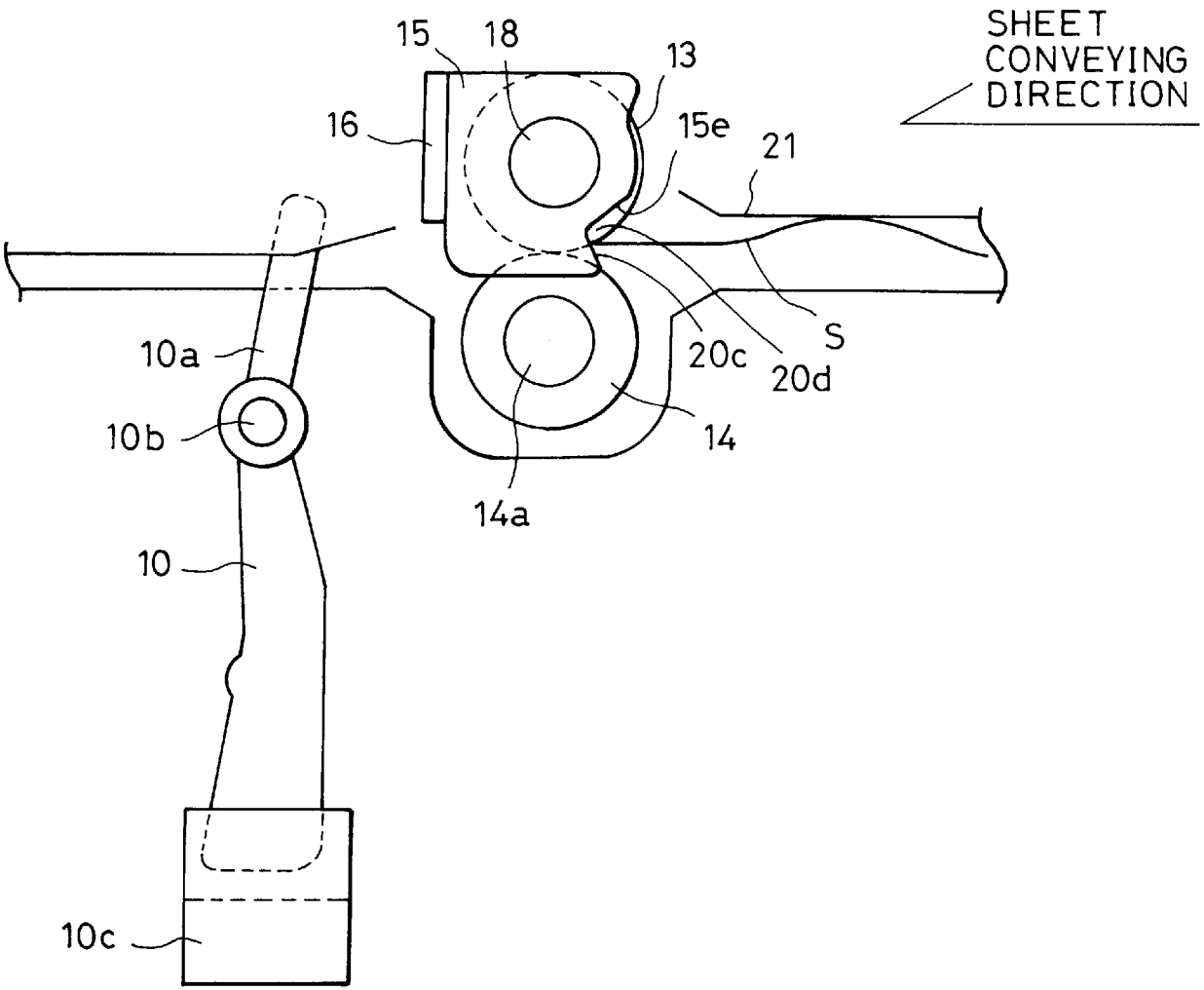
FIG. 9 is a vertical cross sectional view showing the outside shape of the collision surface of the shutter member of a third embodiment.

Next, a third embodiment of the obliquely traveling sheet correcting device according to the present invention and the image forming apparatus provided with the obliquely traveling sheet correcting device will be described using FIG. 9. FIG. 9 is a vertical cross sectional view showing the outside shape of the collision surface 20*c* of the shutter member of the third embodiment. Note, components arranged similarly to those of the first embodiment are denoted by the same numerals and the description thereof is omitted.

In the first embodiment, when the shutter member 15 is located at the position of the first attitude, the collision surface 20*a* of the shutter member 15 is formed in the direction perpendicular to the surface of the sheet S being conveyed (as shown in FIG. 5) and the collision surface 20*a* is across the surface of the sheet S which collides against the collision surface 20*a* at approximately 90°. In this case, there is a possibility that the leading edge of the sheet S escapes to the lower side of the FIG. 5 from the collision surface 20*a* depending upon how the loop of the sheet S is formed.

To prevent this drawback, the third embodiment is arranged such that when the shutter member 15 is located at the position of the first attitude, the collision surface 20*c* of the shutter member 15 is formed in the direction of an acute angle below 90° in the clockwise direction of FIG. 9 from the side from which the sheet S is conveyed with respect to the surface of the sheet S being conveyed and the collision surface 20*c* is across the surface of the sheet S to be collided thereagainst at an acute angle below 90° as shown in FIG. 9.

With this arrangement, the leading edge of the sheet S drops into a groove 20*d* as a holding portion formed by the collision surface 20*c* and the edge 15*e* of the shutter member 15 and does not escape from the collision surface 20*c* contrary to the aforesaid case, so that the leading edge of the sheet S is securely locked. As a result, the oblique travel of the sheet S can be corrected. The other arrangement of the third embodiment is similar to that of the first embodiment and an advantage similar to that of the first embodiment can be obtained.

Figure 10:
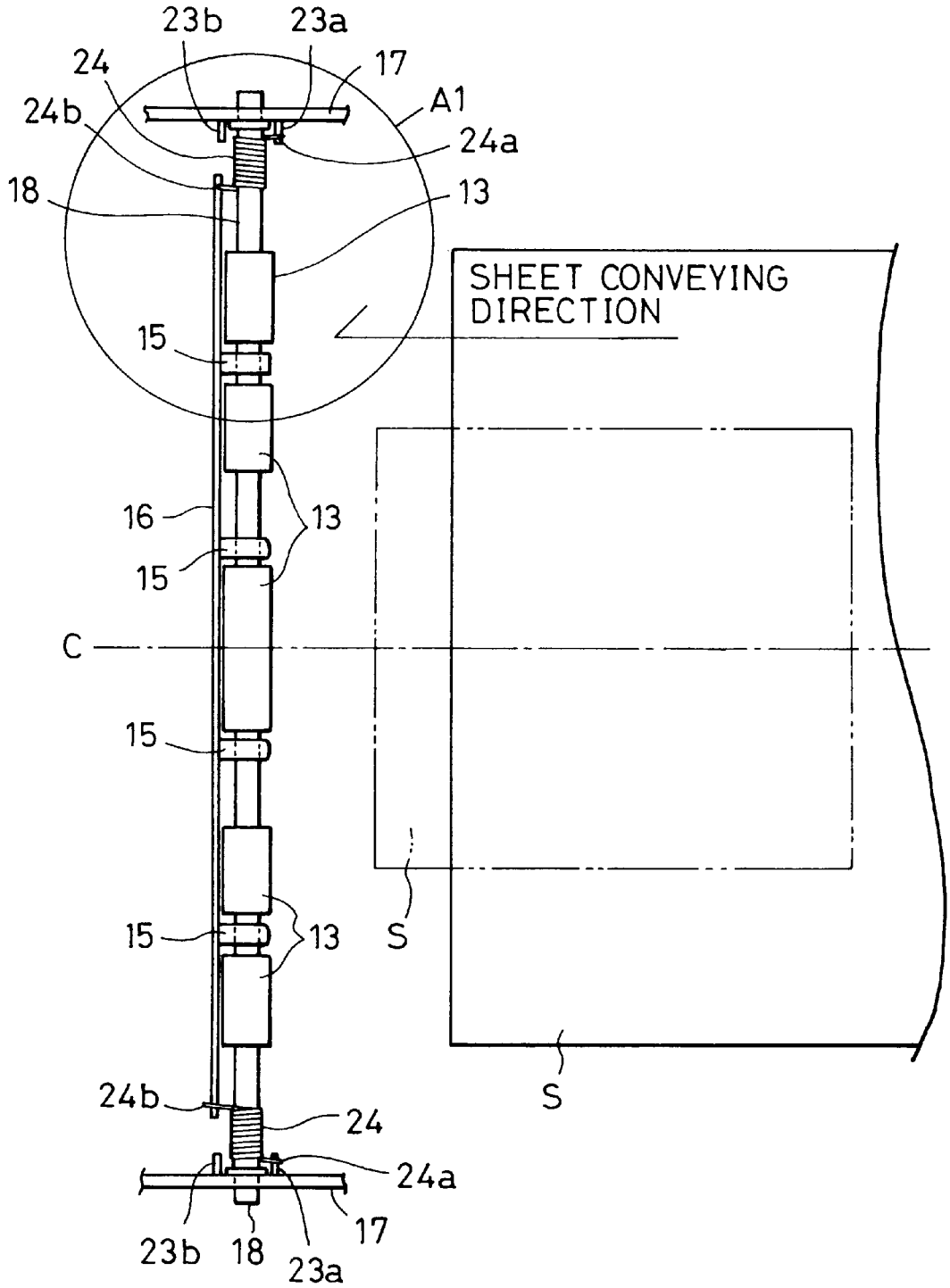
FIG. 10 is a plan view showing the arrangement of the obliquely traveling sheet correcting device of a fourth embodiment.
Figure 11:
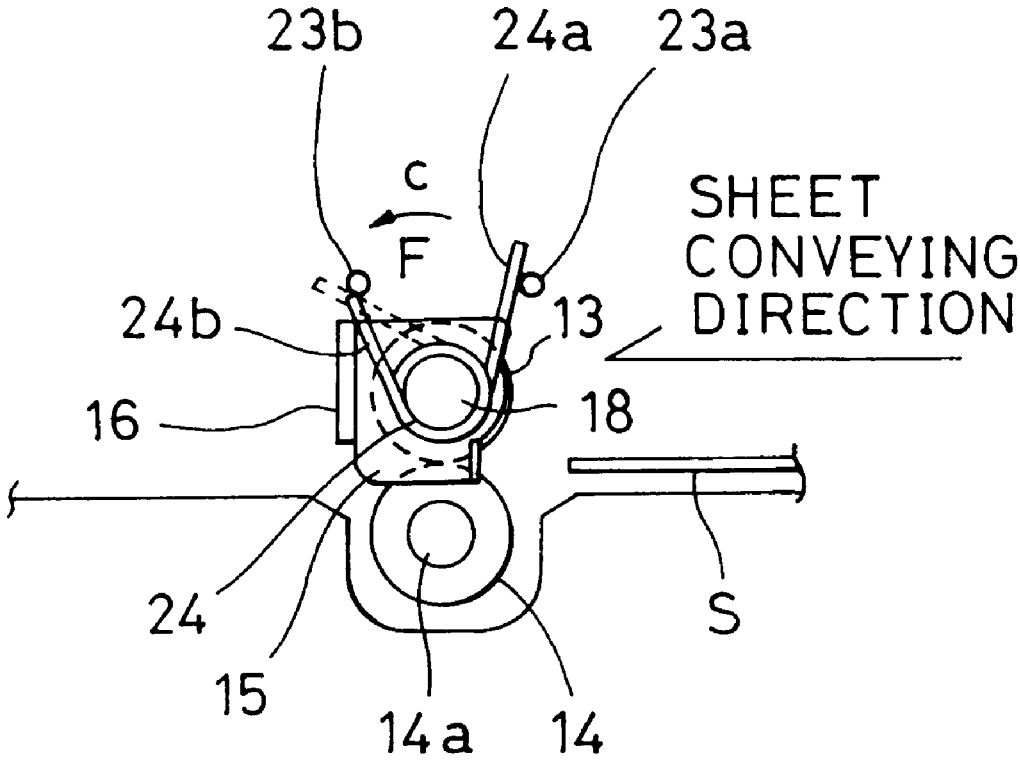
FIG. 11 is a cross sectional view illustrating the arrangement of the obliquely traveling sheet correcting device of the fourth embodiment.
Figure 12:
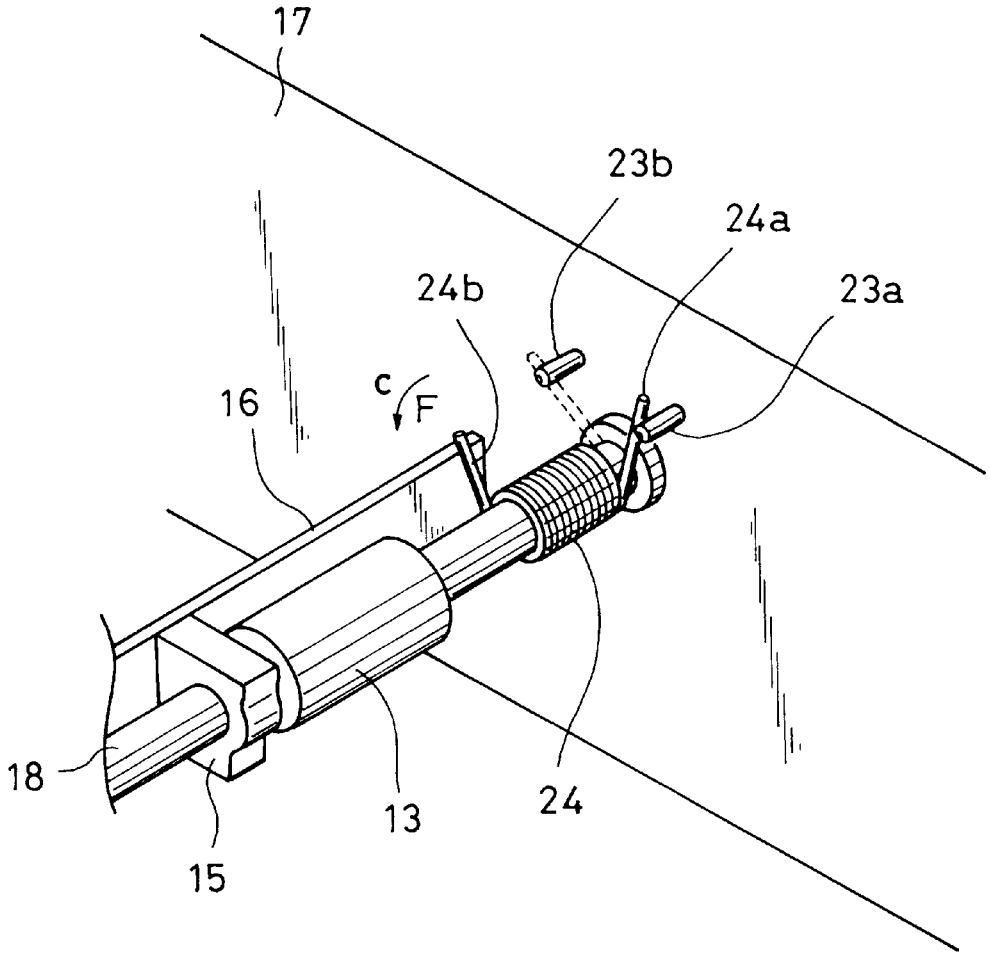
FIG. 12 is an enlarged perspective view of the $A_1$ portion in FIG. 10.

Next, a fourth embodiment of the obliquely traveling sheet correcting device according to the present invention and the image forming apparatus provided with the obliquely traveling sheet correcting device will be described using FIG. 10 to FIG. 12. FIG. 10 is a plan view showing the arrangement of the obliquely traveling sheet correcting device of the fourth embodiment, FIG. 11 is a cross sectional view describing the arrangement of the obliquely traveling sheet correcting device of the fourth embodiment and FIG. 12 is a perspective enlarged view of the $A_1$ portion in FIG. 10 and shows the main portion of the reaction force switching means of urging means. Note, components arranged similarly to those of the first embodiment are denoted by the same numerals and the description thereof is omitted.

As shown in FIG. 10, the fourth embodiment is arranged such that a twisted coil spring 24 acting as urging means for urging a shutter member 15 to the position of the above first attitude is additionally disposed to the obliquely traveling sheet correcting device arranged similarly to that of the first embodiment.

The twisted coil spring 24 is slidingly engaged with a rotary shaft 18 with the end 24*b* thereof on the side of a connecting member 16 being secured to the connecting member 16 as well as the end 24*a* thereof on the side of a device main body frame 17 being suitably selectively locked to first and second projections 23*a*, 23*b* acting as reaction force switching means disposed to the frame 17.

For example, the end 24*a* of the twisted coil spring 24 on the frame 17 side is secured to the first projection 23*a* in the case of a sheet S having normal stiffness. With the above arrangement, the shutter member 15 is urged in the direction of the arrow c in FIG. 11 at all times by the twisted coil spring 24.

Further, an urging force F acting in the direction of the arrow c in FIG. 11 can be increased by switching the end 24*a* of the twisted coil spring 24 on the frame 17 side to the second projection 23*b* in the above arrangement. Thus, a suitable urging force F can be obtained by selectively locking the end 24*a* of the twisted coil spring 24 on the frame 17 side to the first and second projections 23*a*, 23*b* according to the stiffness of the sheet S being used.

Since the sheet S can be conveyed with the oblique travel thereof corrected by the shutter member 15 approximately similarly to the first embodiment, the detail of the correcting operation is not described here.

As the sheet S, various types of the sheet S ranging from thin paper having a weight of about 50 g/m$^2$ to thick paper having a weight of about 120 g/m$^2$ will be used.

When the sheet S is the thin paper, the stiffness of the sheet is weak, and therefore the sheet S is liable to form a loop even if the urging force F of the shutter member 15 is small so that the oblique travel of the sheet S can be easily corrected.

Whereas, since the stiffness of the sheet S is weak, when the urging force F produced by the twisted coil spring 24 is set larger than necessary, the sheet S turns the shutter member 15 in the direction opposite to the arrow c of FIG. 11 and retracts it, thus the sheet S has difficulty passing through the shutter member 15 and a problem of jam and the like arises.

Further, when the sheet S is the thick paper, it is difficult to form a loop when the urging force F of the shutter member 15 is weak because the sheet S has strong stiffness and thus the oblique travel of the sheet S may not be perfectly corrected. Thus a problem arises in that the sheet S turns and retracts the shutter member 15 and passes therethrough.

If it is assumed that the urging force F is set to such a degree that even the sheet S having the weakest stiffness among the sheets S to be used turns and retracts the shutter member 15 and passes therethrough when the end 24*a* of the twisted coil spring 24 on the frame 17 side is locked to the first projection 23*a* in this embodiment, when the sheet S having relatively strong stiffness such as the thick paper and the like is conveyed in this state, the amount of correction of the oblique travel of the sheet S is made smaller than the amount of correction made to the thin paper.

At the time, when the end 24*a* of the twisted coil spring 24 on the frame 17 side is switched to the second projection 23*b*, the urging force F is increased and a large amount of correction of the oblique travel can be secured even to the thick paper.

With the arrangement of the fourth embodiment as described above, it is possible to exhibit a large oblique travel correcting capability to the sheet S such as the thick paper and the like having relatively strong stiffness while securing a conveying capability to the sheet S having relatively weak stiffness such as the thin paper and the like.

Note, although the fourth embodiment adjusts the urging force F produced by the twisted coil spring 24 by changing the position to which the end 24*a* of the twisted coil spring 24 on the frame side 17 is locked, the present invention is not limited to the above arrangement but it can be arranged by using various other means capable of adjusting the urging force F for urging the shutter member 15 to the position of the first attitude.

Figure 13:
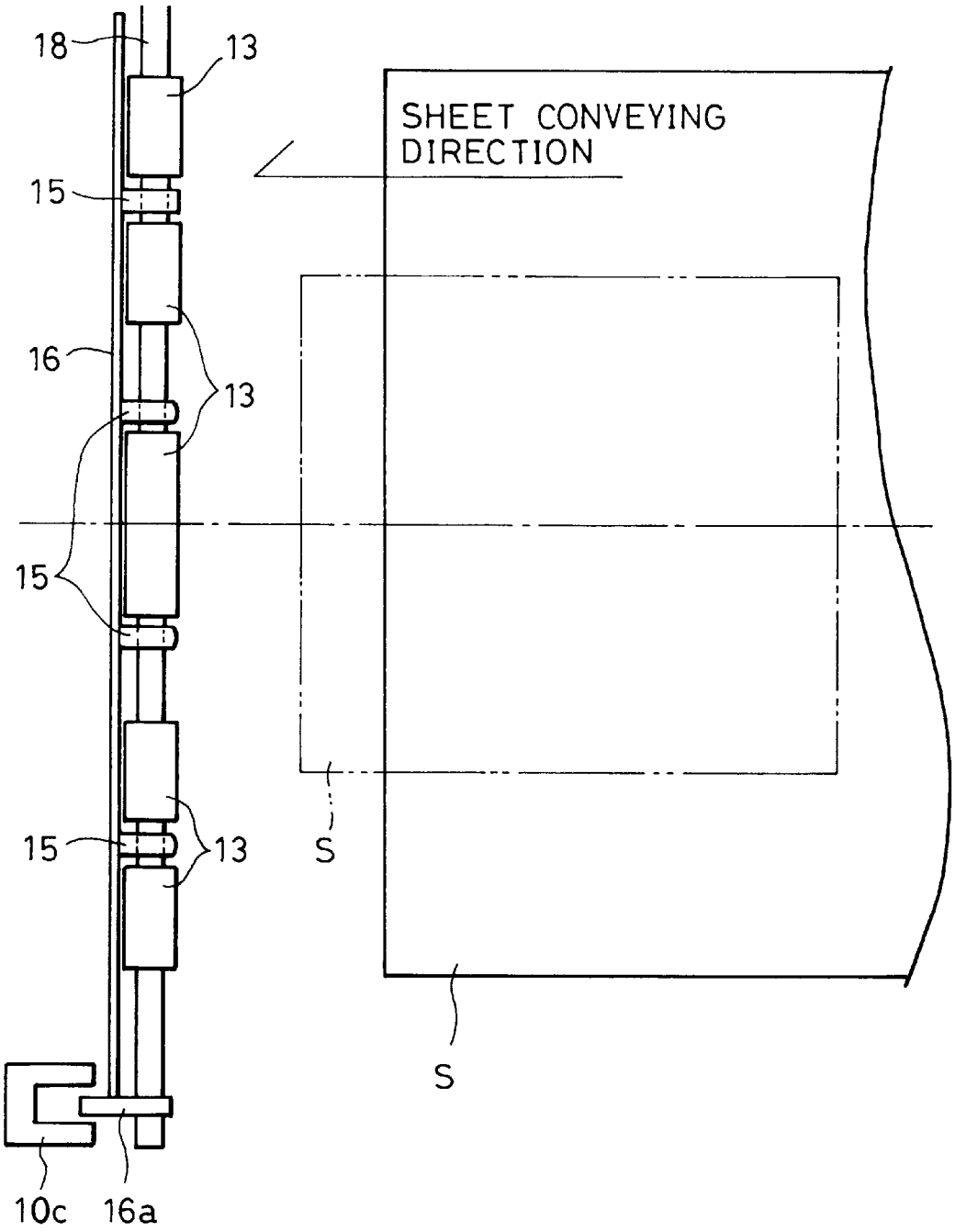
FIG. 13 is a plan view showing the arrangement of the obliquely traveling sheet correcting device of a fifth embodiment.

Next, a fifth embodiment of the obliquely traveling sheet correcting device according to the present invention and the image forming apparatus provided with the obliquely traveling sheet correcting device will be described using FIG. 13 and FIG. 14. FIG. 13 is a plan view showing the arrangement of the obliquely traveling sheet correcting device of the fifth embodiment and FIG. 14(*a*) and FIG. 14(*b*) are cross sectional views describing the arrangement of the obliquely traveling sheet correcting device of the fifth embodiment. Note, components arranged similarly to those of the first embodiment are denoted by the same numerals and the description thereof is omitted.

As shown in FIG. 13, the fifth embodiment is arranged such that the obliquely traveling sheet correcting device arranged similarly to that of the first embodiment is provided with a sensor flag 16*a* integrally therewith to actuate a sensing unit 10*c* acting as a sheet sensing means.

Provided with an end of a rotary shaft 18 is the sensor flag 16*a* which is engaged with the rotary shaft 18 and journaled with respect to the rotary shaft 18 as well as securely fixed to a connecting member 16. The sensor flag 16*a* can be turned integrally with the connecting member 16 about the rotary shaft 18 and when a shutter member 15 turns, the sensor flag 16*a* is turned integrally with the shutter member 15 in synchronism therewith.

A sensing unit 10*c* constituting sheet sensing means is disposed at a position confronting the sensor flag 16*a* likewise the first embodiment. As shown in FIG. 14(*a*), when the shutter member 15 is located at the position of a first attitude where it is abutted against the leading edge of a sheet S to thereby stop the leading end of sheet S, the sensor flag 16*a* is set at a position where the light passage of the sensing unit 10*c* is opened.

Figure 14A:
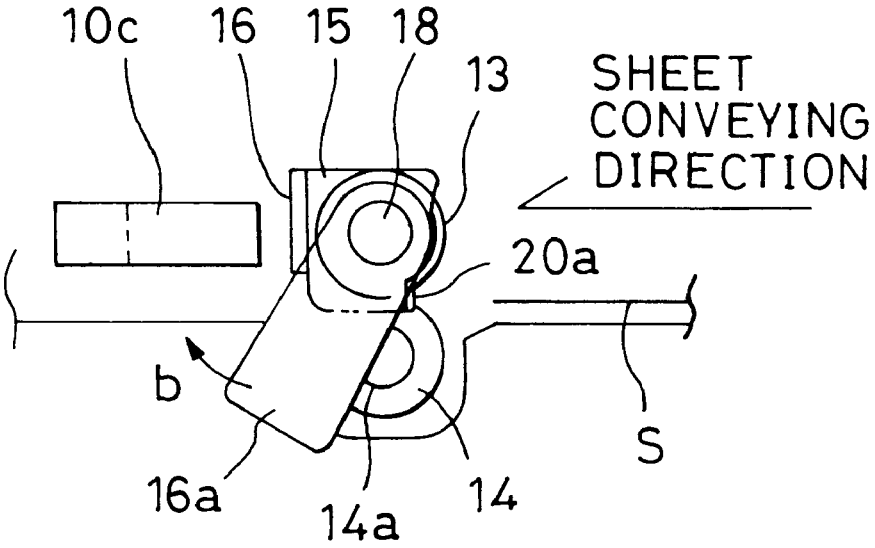
FIG. 14(*a*) and FIG. 14(*b*) are cross sectional views illustrating the arrangement of the obliquely traveling sheet correcting device of the fifth embodiment.
Figure 14B:
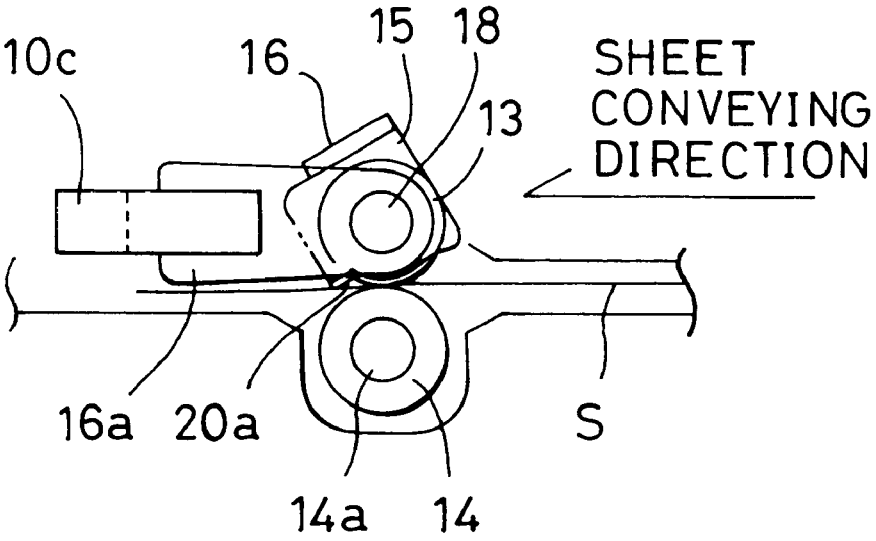

Further, as shown in FIG. 14(*b*), when the shutter member 15 is located at the position of a second attitude where it permits the sheet S to pass therethrough, the sensor flag 16*a* is set to a position where the light passage of the sensing unit 10*c* is shut off.

In the above arrangement, after the leading edge of the sheet S conveyed by a pair of conveyer rollers 5 likewise the first embodiment is locked by being abutted against the collision surface 20*a* of the shutter member 15 and the oblique travel thereof is corrected by the formation of a loop, the shutter member 15 is turned by being pushed upward and retracted so that the sheet S passes therethrough. At the time, the sensor flag 16*a* is turned about the rotary shaft 18 by the same angle as that of the shutter member 15 in the direction of the arrow b in FIG. 14(*a*) to thereby shut off the light passage of the sensing unit 10*c*.

Figure 15:
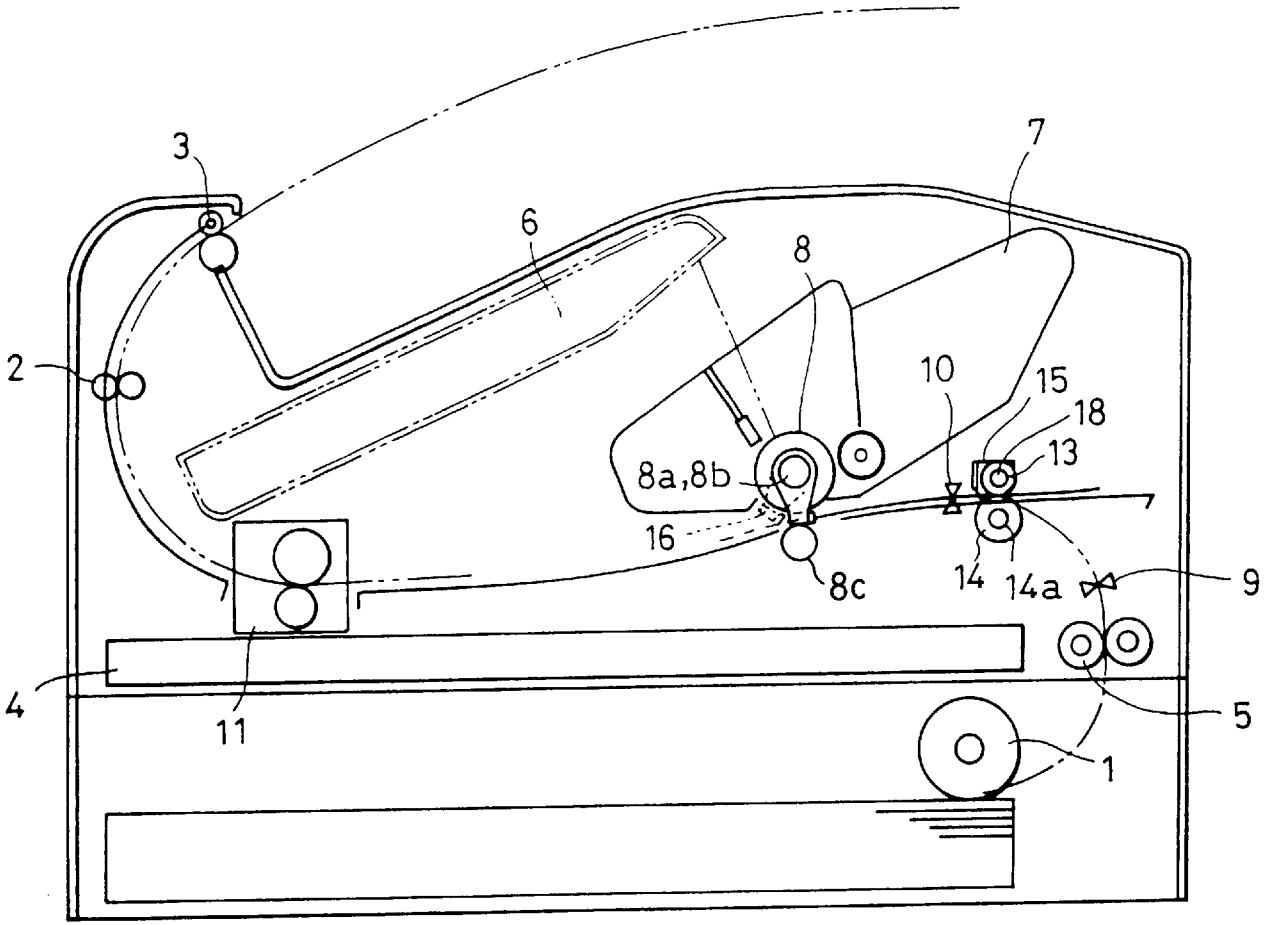

With reference to FIG. 15, a laser scanner 6 forms a latent image on the surface of a photoreceptor drum 8 in response to the information detected by the sensor unit 10 and a toner image is formed on the surface of the photoreceptor drum 8 by a series of processing operation effected by a process cartridge 7. The toner image which is formed on the surface of the photoreceptor drum 8 is transferred to the sheet S conveyed in synchronism with the rotational motion of the photoreceptor drum 8.

Although a plurality of the shutter members 15 are connected by a connecting member 16 and the sensor flag 16*a* is securely fixed to the connecting member 16 in the fifth embodiment, the shutter members 15, the connecting member 16 and the sensor flag 16*a* may be integrally formed.

The sensor flag 16*a* is disposed to the connecting member 16 for connecting the shutter members 15, the sensor flag 16*a* associating with the turning operation of the shutter members 15 actuates the sensing unit 10*c* and the image forming operation of image forming means is started in response to the information detected by the sensing unit 10*c* in the aforesaid embodiment. Therefore, a timing at which an image is formed can be maintained constant regardless of a period of time necessary for the sheet S to pass through the shutter members 15. Moreover, since a portion of the shutter members 15 also serves as a portion of the sheet sensing means, the number of parts can be reduced to thereby lower the cost of the device.

Figure 16:
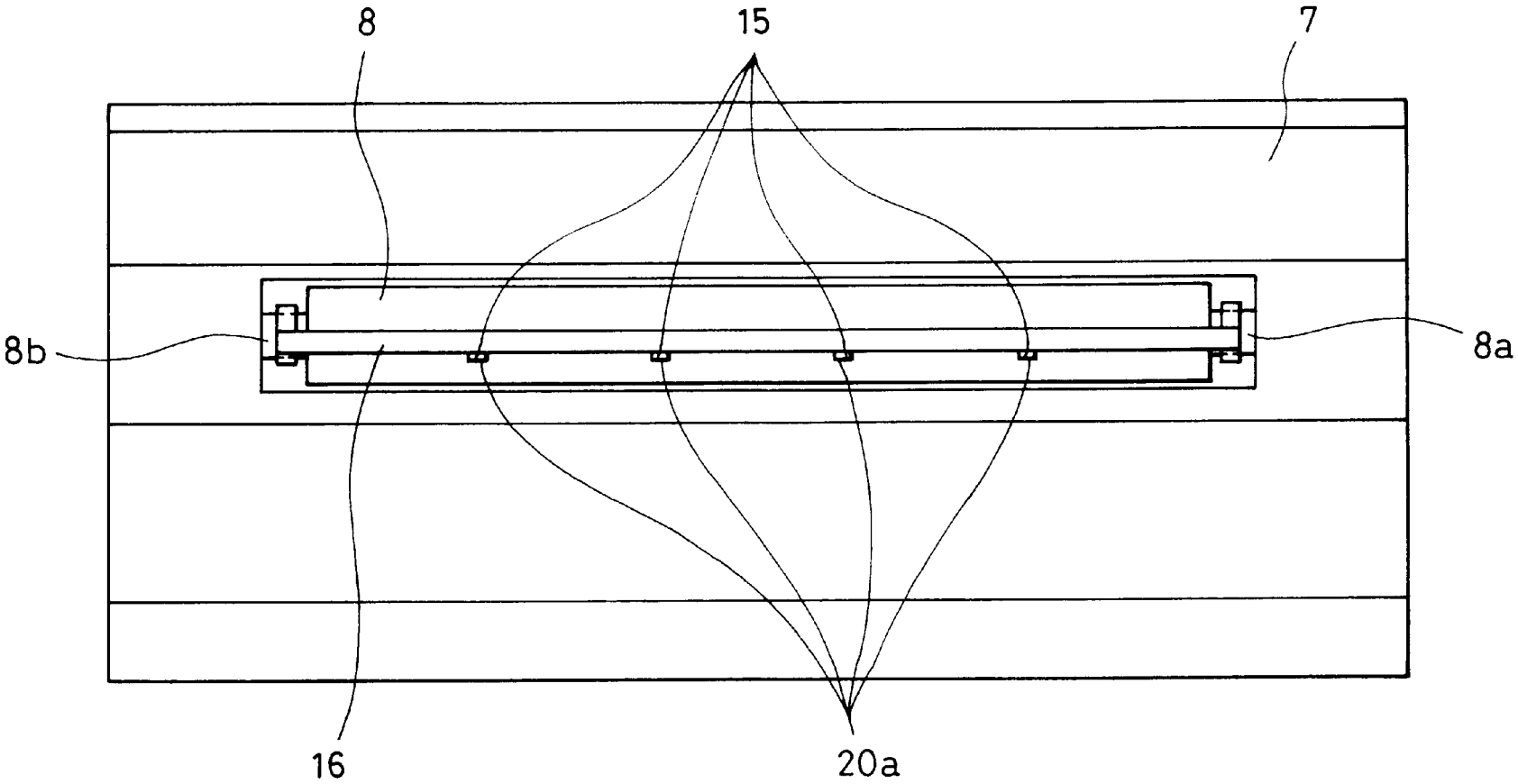
FIG. 16 is a fragmentary view from the direction of arrow $A_2$ in FIG. 15.

Next, a sixth embodiment of the obliquely traveling sheet correcting device according to the present invention and the image forming apparatus provided with the obliquely traveling sheet correcting device will be described using FIG. 15 and FIG. 16. FIG. 15 is a cross sectional view showing the arrangement of the image forming apparatus provided with the obliquely traveling sheet correcting device of the sixth embodiment and FIG. 16 is a view of the obliquely traveling sheet correcting device from the direction of arrow $A_2$ in FIG. 15. Note, components arranged similarly to those of the first embodiment are denoted by the same numerals and the description thereof is omitted.

In the sixth embodiment, the obliquely traveling sheet correcting device according to the present invention is arranged integrally with a process cartridge 7 and a shutter member 15 is arranged to be able to turn about the rotational axis of a photoreceptor drum 8 as an image carrying rotary body acting as second sheet carrying means. In FIG. 16, a plurality of shutter members 15 each having a collision surface 20*a* are integrally connected by a connecting member 16 and the connecting member 16 is supported so that it can be turned about dowels 8*a*, 8*b* disposed to both the ends of the photoreceptor drum 8 with respect to them.

When the shutter member 15 is located at the position of a first attitude where it can stop the leading edge of a sheet S by being abutted against the leading edge thereof as shown by a solid line in FIG. 15, the collision surface 20*a* of the shutter member 15 is located in the vicinity of but also upstream of the nip portion between the photoreceptor drum 8 and an image transfer electrizer 12 or a transfer rotary body 8C (FIG. 15A). The position of the shutter member 15 shown by the broken line of FIG. 15 is the position of a second attitude where the sheet S is permitted to pass through the shutter member 15. The other arrangements of the sixth embodiment are similar to that of the first embodiment and similar advantages can be obtained.

With the above arrangement, after the oblique travel of the sheet S is corrected by the shutter member 15 disposed to a pair of conveyer roller 13, 14 as in the first embodiment, the sheet S is conveyed by the pair of conveyer rollers 13, 14 acting in this embodiment as first sheet conveyer means. Next, when the leading edge of the sheet S is abutted against the collision surface 20*a* of the shutter member 15 located at the position of the first attitude shown by the solid line in FIG. 15, the sheet S forms a loop likewise the first embodiment so that the oblique travel thereof is corrected by the stiffness of the sheet S itself. Thereafter, when the shutter member is pushed and turned about the dowels 8*a*, 8*b* clockwise in FIG. 15 and located at the position of the second attitude shown by the broken line in FIG. 15, the sheet S is conveyed downstream by passing through the shutter member 15.

According to the above arrangement, since the shutter member 15 is mounted to the dowels 8*a*, 8*a* of the photoreceptor drum 8 disposed in the process cartridge 7 so that it is free to turn, the shutter member 15 can be accurately aligned with the photoreceptor drum 8. That is, the alignment of the sheet S with the photoreceptor drum 8 can be accurately maintained, so that the accuracy of a recorded image can be further enhanced.

Although the connecting member 16 for connecting the shutter member 15 is mounted so as to turn about the dowels 8*a*, 8*b* of the photoreceptor drum 8 in the sixth embodiment, a similar advantage can be obtained even if the shutter member 15 is disposed so as to turn about the rotational axis of an image transfer rotary body when the image transfer electrizer 12 composed of the image transfer rotary body as another embodiment.

Figure 17:
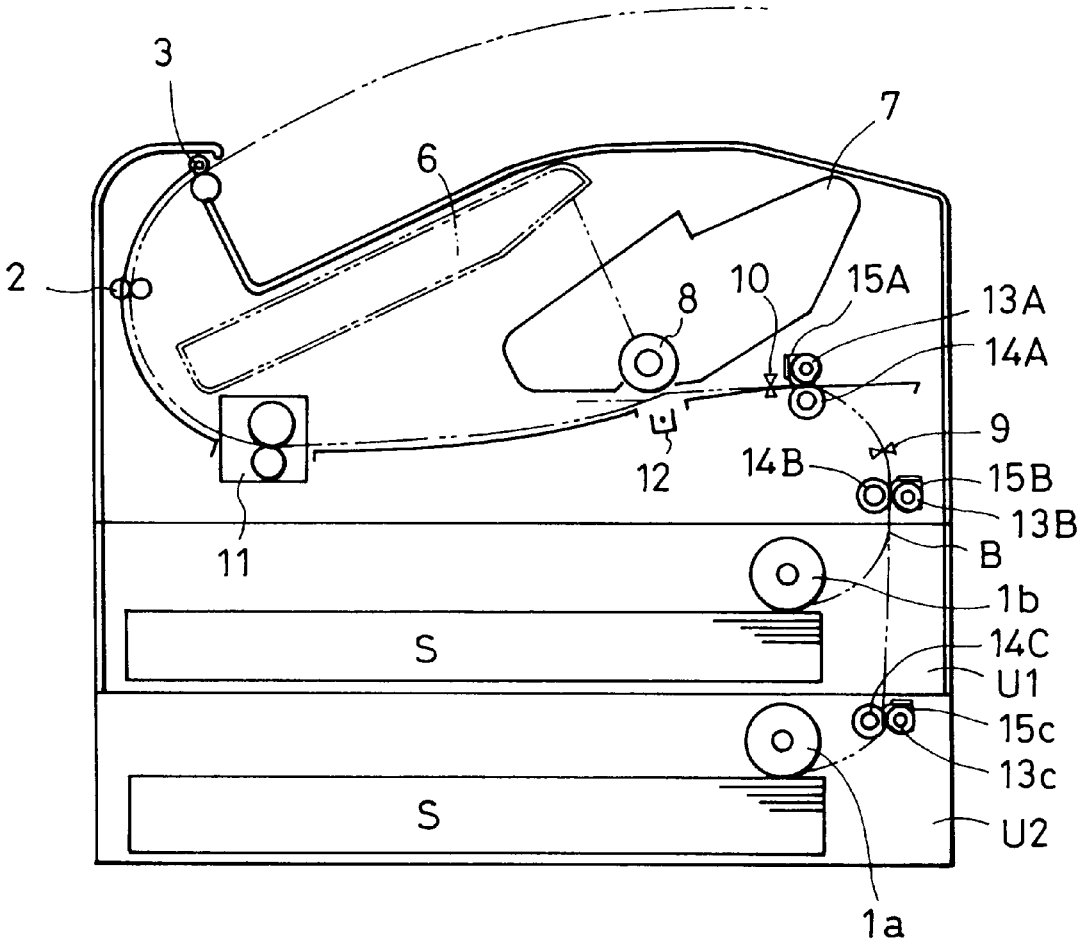
FIG. 17 is a cross sectional view showing the arrangement of the image forming apparatus provided with the obliquely traveling sheet correcting device of a seventh embodiment.

Next, a seventh embodiment of the obliquely traveling sheet correcting device according to the present invention and the image forming apparatus provided with the obliquely traveling sheet correcting device will be described using FIG. 17. FIG. 17 is a cross sectional view showing the arrangement of the image forming apparatus provided with the obliquely traveling sheet correcting device of the seventh embodiment. The components arranged similarly to those of the first embodiment are denoted by the same numerals and the description thereof is omitted.

The seventh embodiment has a plurality of the obliquely traveling sheet correcting devices which are arranged similarly to that of the first embodiment and disposed on a conveyer passage for conveying a sheet S. In the image forming apparatus of the seventh embodiment shown in FIG. 17, feed units U1, U2 are arranged at two stages located upward and downward. Then, a pair of conveyer rollers 13A, 14A provided with a shutter member 15A as the obliquely traveling sheet correcting device are disposed upstream of a process cartridge 7 in the vicinity thereof as in the first embodiment.

A pair of conveyer rollers 13B, 14B provided with a shutter member 15B and the like as the obliquely traveling sheet correcting device arranged similarly to that of the first embodiment are also disposed downward of the joint point of the sheet conveyer passages from the feed units U1, U2 of the main body of the device in the vicinity thereof.

A pair of conveyer rollers 13C, 14C provided with a shutter member 15C and the like as the obliquely traveling sheet correcting device arranged similarly to that of the first embodiment are disposed to the lower feed unit U2 which has a relatively long conveyer passage for the sheet S up to an image forming unit confronted by a photoreceptor drum 8 disposed to the process cartridge 7.

Further, sensors 9, 10 acting as sensing means are disposed downstream of the pair of conveyer rollers 13A, 14A and the pair of conveyer rollers 13B, 14B in the vicinity thereof likewise the first embodiment, respectively. The other arrangements of the seventh embodiment are similar to that of the first embodiment and advantages similar to that of the first embodiment can be obtained.

With the above arrangement, the sheet S which was drawn out from the feed unit 1 by a feed roller la acting as first sheet conveyer means first forms a loop between the feed roller 1*a* and the pair of conveyer rollers 13C, 14C acting as second sheet conveyer means to thereby correct the oblique travel thereof, then is conveyed downstream and further forms a loop between the pair of conveyer rollers 13C, 14C acting as first sheet conveyer means this time and the pair of conveyer rollers 13B, 14B acting as second sheet conveyer means to thereby correct the oblique travel thereof again. Thereafter, the sheet S is conveyed downstream and further forms a loop between the pair of conveyer rollers 13B, 14B acting as the first sheet conveyer means tins time and the pair of conveyer rollers 13A, 14A acting as second sheet conveyer means to thereby correct the oblique travel thereof once more again and then conveyed to an image forming unit confronted by the photoreceptor drum 8 disposed to the process cartridge 7.

Further, the sheet S which was drawn out from the feed unit 1 by a feed roller 1*b* acting as first sheet conveyer means first forms a loop between the feed roller 1*b* and the pair of conveyer rollers 13B, 14B acting as second sheet conveyer means to thereby correct the oblique travel thereof, then is conveyed downstream and further forms a loop between the pair of conveyer rollers 13B, 14B acting as first sheet conveyer means this time and the pair of conveyer rollers 13A, 14A acting as second sheet conveyer means to thereby correct the oblique travel thereof again. Thereafter, the sheet S is conveyed to the image forming unit opposing the photoreceptor drum 8 disposed in the process cartridge 7.

With these arrangements, even if the length of the conveyer passage of the sheet S from the feed unit U where the sheet S is accommodated to the process cartridge 7 acting as the image forming means is relatively long, since the plurality of obliquely traveling sheet correcting devices are disposed at various positions, the oblique travel of the sheet S can be corrected on the conveyer passage of the sheet S as necessary. As a result, even if the sheet S being conveyed is caused to travel obliquely by a conveying resistance and the like arising in the sheet conveyer passage, the oblique travel can be corrected at the predetermined positions when necessary before the amount of the oblique travel is accumulated and increased, and thus image recording accuracy can be further enhanced.

Although the seventh embodiment shows an example that the obliquely traveling sheet correcting devices according to the present invention are disposed at the three positions, the desired number of the obliquely traveling sheet correcting devices may also be disposed to other desired positions.

Figure 18:
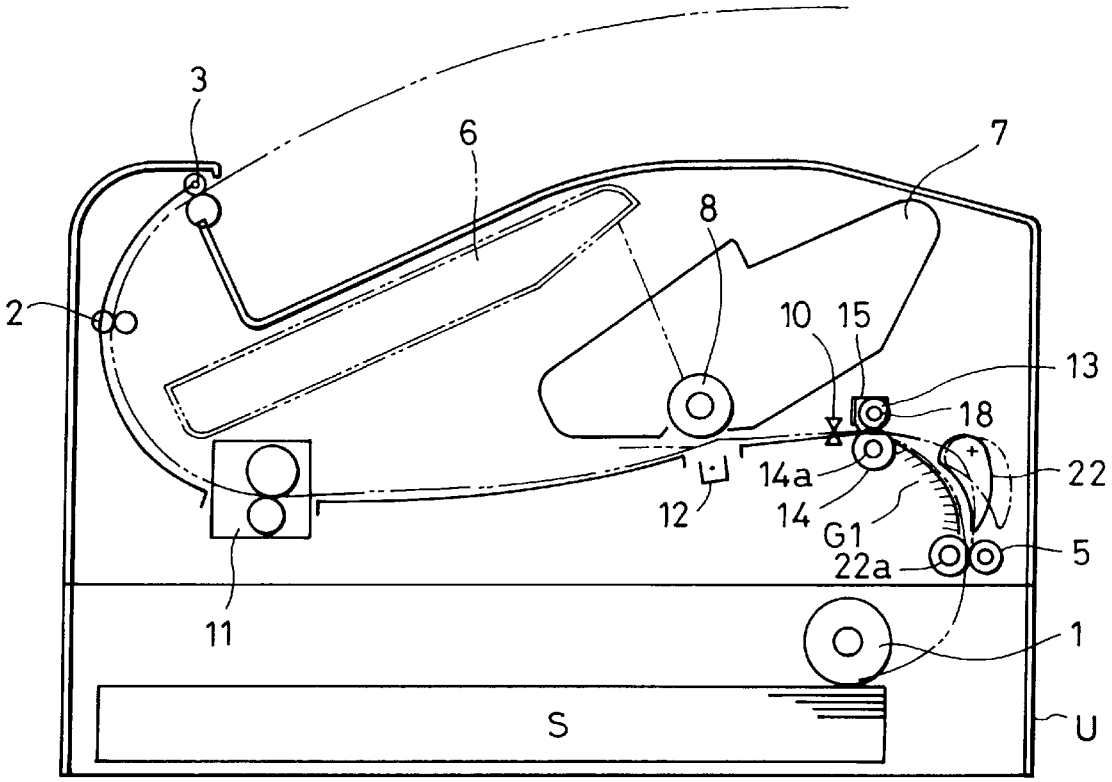
FIG. 18 is a cross sectional view showing the arrangement of the image forming apparatus provided with the obliquely traveling sheet correcting device of an eighth embodiment.

Next, an eighth embodiment of the obliquely traveling sheet correcting device according to the present invention and the image forming apparatus provided with the obliquely traveling sheet correcting device will be described using FIG. 18. FIG. 18 is a cross sectional view showing the arrangement of the image forming apparatus provided with the obliquely traveling sheet correcting device of the eighth embodiment. Note, components arranged similarly to those of the first embodiment are denoted by the same numerals and the description thereof is omitted.

In the above respective embodiments, a sheet S must form the amount of a loop which is necessary to correct the oblique travel of the sheet S in the state that the leading edge of the sheet S is abutted against the shutter member 15 and stopped by it. Since the amount of the loop is the same as the amount of the oblique travel of the sheet S to be corrected, when the amount of the oblique travel of the sheet S is large, a predetermined amount of the loop must be stably secured.

In FIG. 18, when the leading edge of the sheet S conveyed by a pair of conveyer rollers 5 acting as first sheet conveyer means is stopped by abutting against the collision surface 20*a* of a shutter member 15 disposed to a pair a conveyer rollers 13, 14 acting as a second sheet conveyer means, the sheet S forms a loop so as to be separated from a conveyer guide surface G, acting as a sheet guide with a predetermined curvature interposed between the pair of conveyer rollers 5 and the pair of conveyer rollers 13, 14.

When there is no member for guiding the sheet S on a side confronting the conveyer guide surface G, at the time the predetermined amount of the loop is formed, there is a problem that the urging force causes the sheet S to increase the size the loop endlessly and eventually buckles so that it cannot enter the nip portion between the conveyer rollers 13, 14, and a jam occurs.

The eighth embodiment for solving the above problem is arranged such that the sheet S whose leading edge is stopped by the shutter member 15 is caused to form a stable loop so that the sheet S can securely pass through the shutter member 15 by turning and retracting the shutter member 15 by pushing it by the stiffness thereof.

In FIG. 18, a flapper member 22, which confronts the conveyer guide surface $G_1$ acting as a sheet guide having a predetermined curvature as well as has a guide surface 22*a* formed to have a curvature corresponding to that of the conveyer guide surface $G_1$, is turnably disposed between the pair of conveyer rollers 5 and the pair of conveyer rollers 13, 14 so as to approach and retract from the conveyer guide surface $G_1$.

The center of turn of the flapper member 22 is disposed in the vicinity of a line extending from the nip portion between the pair of conveyer rollers 5 as shown in FIG. 18. The conveyance of the sheet S is guided by setting the flapper member 22 to the position shown by the solid line of FIG. 18 where the flapper member 22 does not open until the leading edge of the sheet S conveyed along the conveyer guide surface $G_1$ enters the shutter member 15.

Then, the time when the leading edge of the sheet S is stopped by abutting against the shutter member 15 and the sheet S forms a loop, the flapper member 22 is opened by being turned to the position shown by the broken line in FIG. 18 so that the sheet S can form the loop which is sufficient to correct the oblique travel thereof.

At least two sets of the flapper members 22 are disposed on the same line in the width direction of the sheet S in correspondence to the width of the sheet S being conveyed so that they can be abutted against at least both the edges of the sheet S being conveyed in the vicinity thereof in a sheet conveying direction. As a result, the flapper members 22 can absorb the difference between the amounts of a loop on the right and left sides of the sheet S as well as prevent that the loop is excessively grown on the contrary and the leading edge of the sheet S is apart from the collision surface 20*a* of the shutter member 15 or enters the nip portion between the pair of conveyer roller 13, 14 before the oblique travel of the sheet S is not completely corrected.

Since the flapper member 22 acts as a force for pushing the loop of the sheet S by being abutted against the sheet S by the dead load thereof, it can sufficiently exhibit an effect even if it is light in weight.

Further, as another arrangement, there may be provided a space, where the sheet S can form a loop in a direction toward which the curvature thereof is increased from the vicinity of the line extending from the nip portion between the pair of conveyer rollers 5, in the region between the pair of conveyer rollers 5 and the pair of conveyer rollers 13, 14 making use of the curvature of the conveyer guide surface $G_1$ shown in FIG. 18 so that the sheet S forms the loop necessary to sufficiently correct the oblique travel thereof by being guided by the space.

Further, an elastic member by which the loop formed by the sheet S is guided may be disposed in confrontation with the conveyer guide surface $G_1$ in place of the flapper member 22 so that the sheet S can form the loop necessary to sufficiently correct the oblique travel thereof by being guided by the elastic member.

Figure 19:
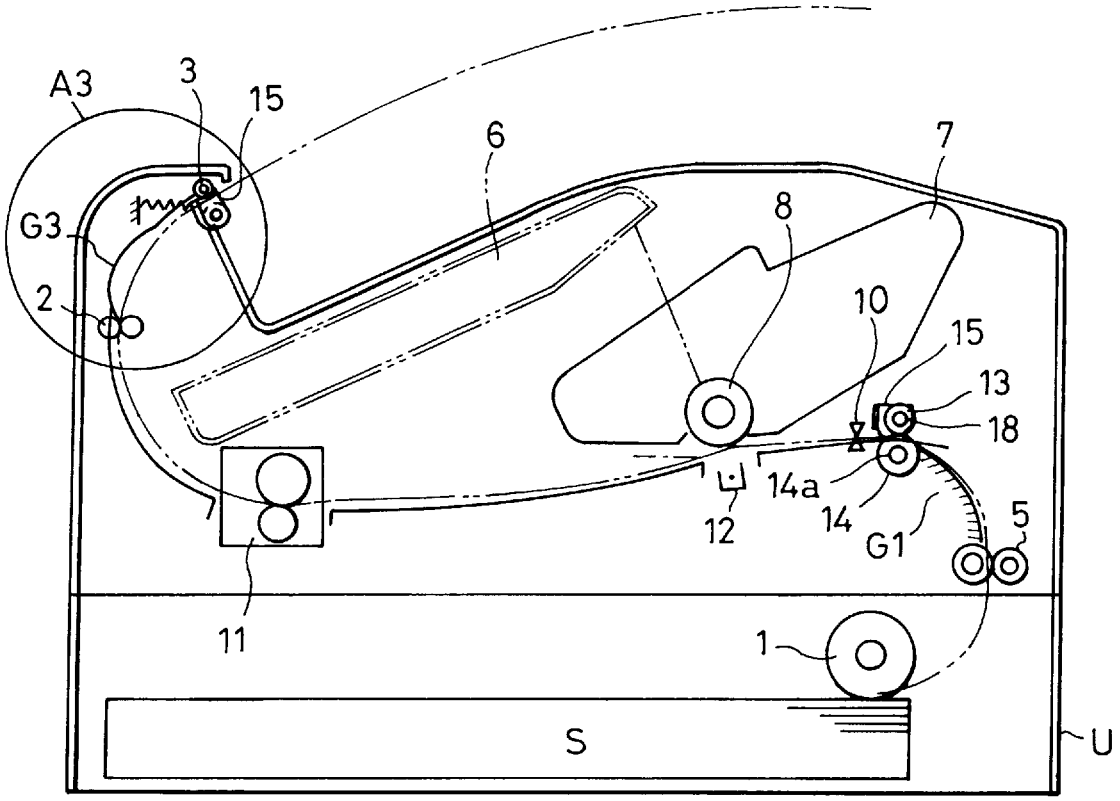
FIG. 19 is a cross sectional view showing the arrangement of the image forming apparatus provided with the obliquely traveling sheet correcting device of a ninth embodiment.
Figure 20:
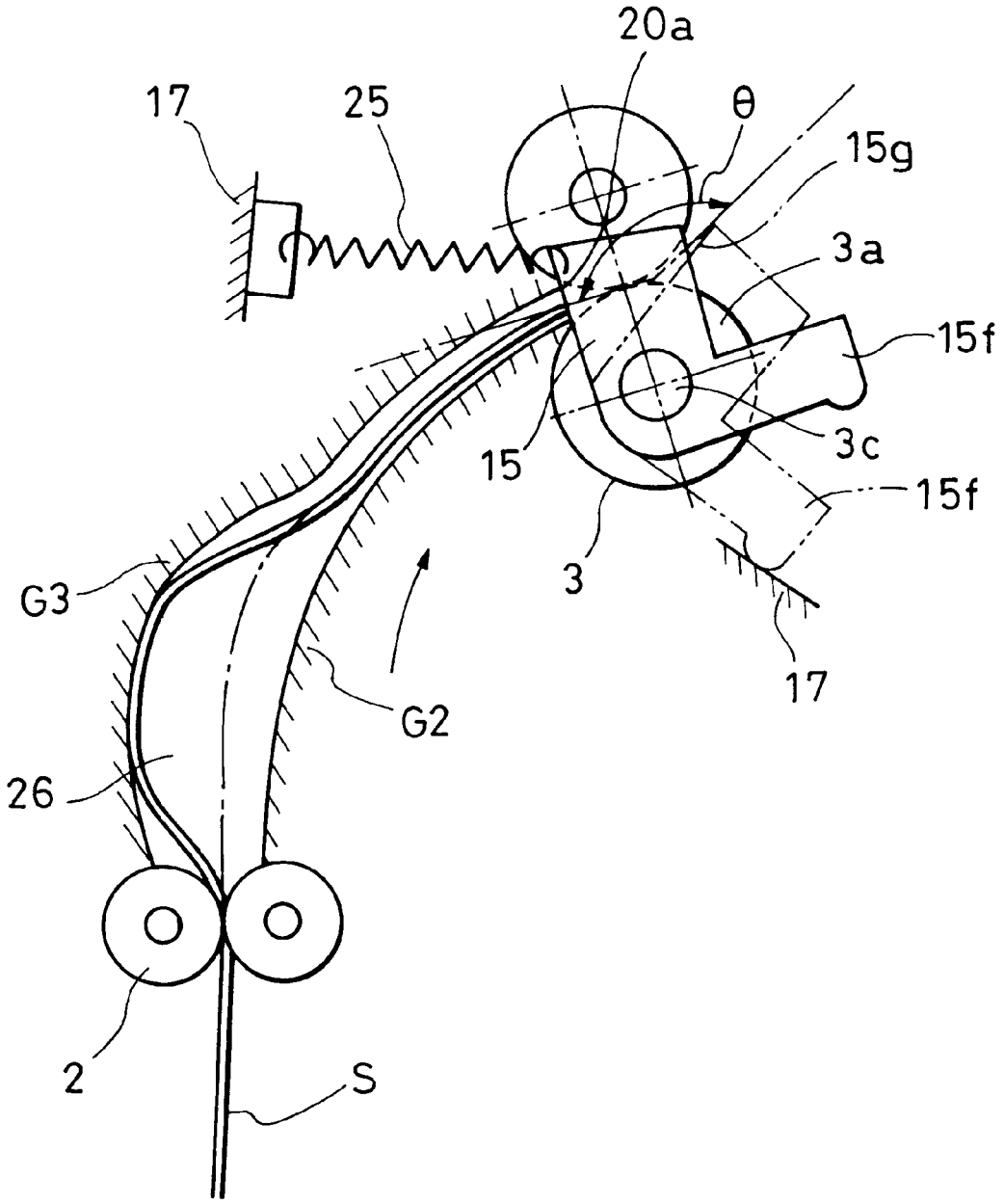
FIG. 20 is a cross sectional view illustrating the main portion of the $A_3$ portion in FIG. 19.
Figure 21:
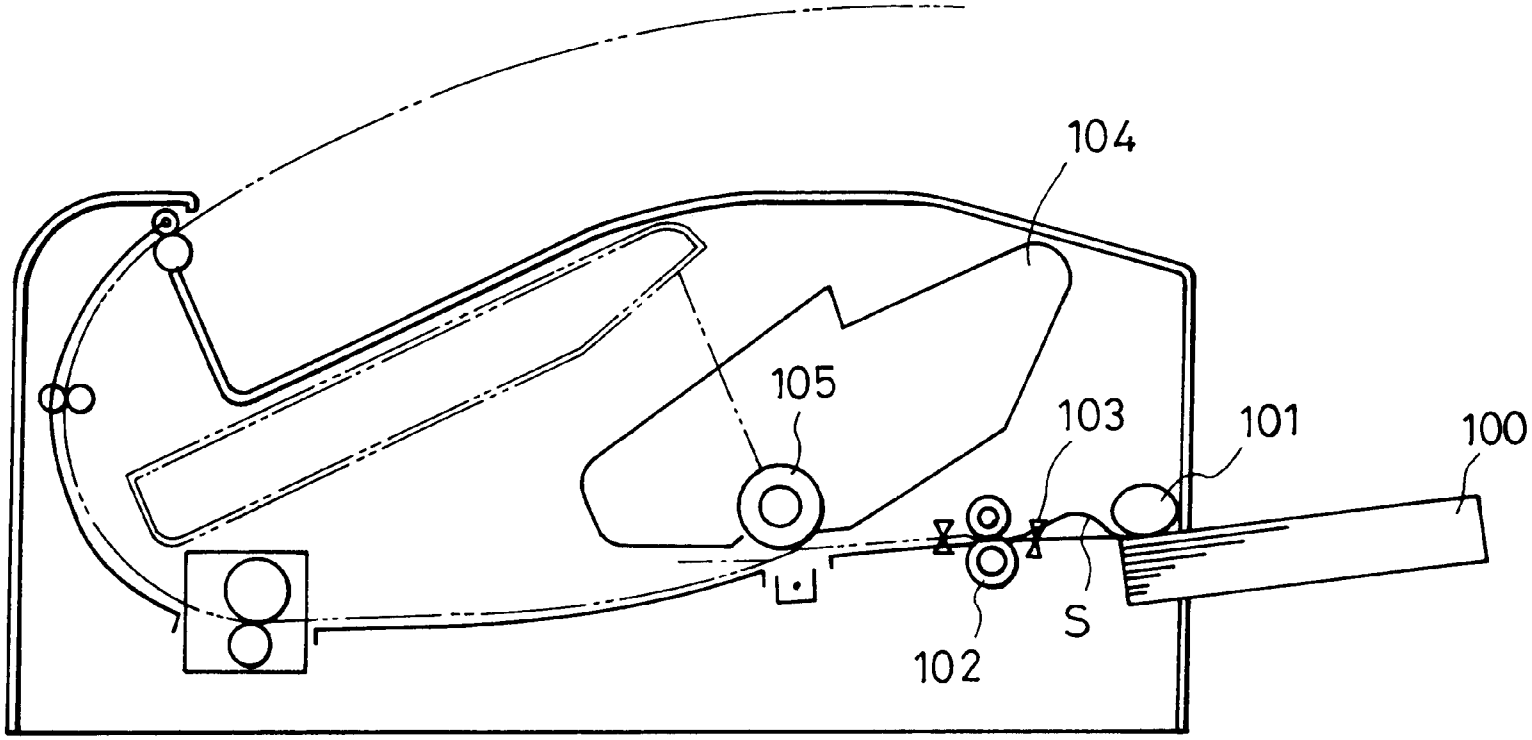
FIG. 21 PRIOR ART
FIG. 21 is a view illustrating a conventional image forming apparatus.

Next, a ninth embodiment of the obliquely traveling sheet correcting device according to the present invention and the image forming apparatus provided with the obliquely traveling sheet correcting device will be described using FIG. 19 and FIG. 20. FIG. 19 is a cross sectional view showing the arrangement of the image forming apparatus provided with the obliquely traveling sheet correcting device of the ninth embodiment and FIG. 20 is a view illustrating the main portion of the $A_3$ portion in FIG. 19. Note, components arranged similarly to those of the first embodiment are denoted by the same numerals and the description thereof is omitted.

The ninth embodiment enhances the drawing-up property of a sheet S when it is discharged by disposing a shutter member 15 constituting the obliquely traveling sheet correcting device to a pair of discharge rollers 3. In particular, a sheet S to which a toner image is fixed by being subjected to heat and press processing in a fixing unit 11 is liable to be curled and if the sheet S is discharged in the curled state, the drawing-up property thereof is lowered.

To cope with this problem, the drawing-up property and loading property of the sheet S can be enhanced when the sheet S is discharged in such a manner that the oblique travel of the sheet S is corrected by forming a loop thereto in front of the pair of discharge rollers 3 as well as an action for removing the curl of the sheet S is added by the cooperation of the shutter member 15 constituting the obliquely traveling sheet correcting device with the pair of discharge rollers 3.

As shown in FIG. 20, the shutter member 15 arranged approximately similarly to that of the first embodiment is mounted to the rotary shaft 3*c* of one of the pair of discharge rollers 3 acting as second sheet conveyer means or the roller 3*a* so that the shutter member 15 can turn about the rotary shaft 3*c* with respect thereto and the other end of an urging spring 25, one end of which is securely fixed to a device main body frame 17, is engaged with one end of the shutter member 15.

As shown by the solid line in FIG. 20, the shutter member 15 is set to the position of a first attitude where the shutter member 15 is abutted against the leading edge of the sheet S, which is conveyed by a pair of discharge rollers 2 acting as first sheet conveyer means, by the urging force of the urging spring 25 and can stop the leading edge thereof.

Then, when the leading edge of the sheet S conveyed by the pair of discharge rollers 2 turns the shutter member 15 about the rotary shaft 3*c* and retracts the same by pushing it, the shutter member 15 is set to the position of a second attitude where an abutting portion 15*f* formed to one end of the shutter member 15 is abutted against the device main frame 17 and permits the sheet S to pass through the shutter member 15.

Further, there are provided between the pair of discharge rollers 2 and the pair of discharge rollers 3 a conveyer guide surface $G_2$ acting as a sheet guide having a predetermined curvature and a conveyer guide surface $G_3$ for forming a space having a shape 26 corresponding to the shape of a loop formed by the sheet S opposing the conveyer guide surface $G_2$.

In these conveyer guide surfaces $G_2$ and $G_3$, the conveyer guide surface $G_3$ forms the space 26 which expands in the left direction in FIG. 20 from the line extending from the nip portion between the pair of discharge rollers 2, so that the loop of the sheet S can be positively formed by the space 26.

With the above arrangement, when the sheet S is conveyed by the pair of discharge rollers 2 and the leading edge of the sheet S is stopped by being abutted against the collision surface 20*a* of the shutter member 15 held at the position of the first attitude by the urging force of the urging spring 25, the sheet S forms a loop in the space 26. Then, when the loop of the sheet S is abutted against the conveyer guide surface $G_3$, the leading edge of the sheet S turns the shutter member 15 about the rotary shaft 3*c* by pushing it to thereby retract it, so that the sheet S passes through the shutter member 15 and enters the nip portion between the pair of discharge rollers 3 so that it is conveyed by being clamped by the nip portion of discharge rollers 3.

At the time, the shutter member 15 is held at the position of the second attitude shown by the broken line of FIG. 2 and the angle θ between the direction toward which the sheet S enters the nip portion between the pair of discharge rollers 3 and the squeezing surface 15*g* of the shutter member 15 is set to a predetermined angle. With this arrangement, the curl of the sheet S is removed in such a manner that the sheet S is squeezed by the action effected between the nip portion between the pair of discharge rollers 3 and the squeezing surface 15*g* of the shutter member 15 and then the sheet S is discharged to the outside of the device.

Since the direction of the curl formed to the sheet S is different depending upon various types of the image forming apparatus, the correction of the oblique travel and the removal of the curl of the sheet S can be executed at one time in correspondence to the various types of the image forming apparatus by suitably changing the urging force of the urging spring 25, the squeezing angle θ, the regulating direction of the shutter member 15 and the like in correspondence to the various types of the image forming apparatus.

In the ninth embodiment, since the obliquely traveling sheet correcting device exhibits a curl removing function in addition to the oblique travel correcting function for the sheet S, the drawing-up property and the loading property of the sheet S after the sheet S is discharged is enhanced.

Although the ninth embodiment shows the case that the obliquely traveling sheet correcting device is disposed near the portion of the image forming device from which the sheet S is discharged, the present invention is not limited thereto but a similar advantage can be obtained by disposing one or a plurality of the obliquely traveling sheet correcting devices at desired positions on a conveyer passage on which the sheet S is conveyed.

Although the above respective embodiments exemplify the case that they are applied to the image forming apparatus provided with electrophotographic image forming means as image forming means, they may be also applied to an image forming apparatus provided with image forming means comprising an ink jet head or a thermal head as other arrangement.

Since the present invention has the arrangement and function as described above and need not use electric control such as the start/stop control of conveyer rollers such as a pair of resist rollers used in the aforesaid prior art, the number of sheet sensing means and the like such as sensors and the like for detecting a sheet can be minimized, and the mechanism for correcting the oblique travel of a sheet can be simply arranged at a low cost and a space can be saved.

Since the urging force of the shutter member to the sheet is adjustable, a sheet conveying capability and an oblique travel correcting capability can be secured regardless of a type of the sheet.

The number of components can be reduced by using a portion of the shutter member also as a portion of the sheet sensing means and a cost can be reduced by it as well as a timing at which the image forming means starts to record an image can be maintained constant regardless of a period of time necessary for the sheet to pass through the shutter member.

Since the space where the sheet forms a loop is secured upstream of the shutter member, a large oblique travel correcting capability can be exhibited.

The sheet oblique travel preventing function can be enhanced by disposing a plurality of the obliquely traveling sheet correcting devices according to the present invention at predetermined positions of the sheet conveyer passage.

The accuracy of positional alignment of the image carrier rotary body and the shutter member can be enhanced by disposing the shutter member to the image carrier rotary body in the process cartridge, whereby an image recording accuracy can be enhanced.

Further, the drawing-up property and the loading property of the sheet can be enhanced when the sheet to which an image has been formed is discharged by the provision of the sheet curl removing function in addition to the sheet oblique travel correcting function.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. An obliquely traveling sheet correcting device, comprising:

first sheet conveyer means for conveying a sheet;

second sheet conveyer means disposed downstream of said first sheet conveyer means for conveying the sheet;

stopping means disposed in the vicinity of said second sheet conveyer means for abutting against the leading edge of the sheet conveyed by said first conveyer means to thereby stop the leading edge of the sheet, said stopping means for swinging between a position of a first attitude where it abuts against the leading edge of the sheet and a second position attitude where it permits the sheet to pass therethrough, wherein said stopping means causes the sheet to form a loop when in the position of the first attitude as the sheet is conveyed by said first sheet conveyor means and is moved to the position of the second attitude by a force from the sheet after the sheet forms the loop, and as said stopping means moves to the position of the second attitude, the leading edge of the sheet stays abutted against said stopping means at least until clamped by said second sheet conveyor means; and urging means for urging said stopping means to the position of the first attitude.

2. An obliquely traveling sheet correcting device according to claim 1, wherein the abutting surface of said stopping means comprises at least three members to be abutted against the leading edge of the sheet, said members disposed at at least three positions along a line running perpendicular to the sheet conveying direction, and at least one position of the members being disposed at the center of the width of the sheet being conveyed.

3. An obliquely traveling sheet correcting device according to claim 1, wherein the abutting surface of said stopping means to be abutted against the leading edge of the sheet is composed of an arc surface having a predetermined radius.

4. An obliquely traveling sheet correcting device according to claim 1, wherein when said stopping means is set to the position of the first attitude where it stops the leading edge of the sheet, the abutting surface of said stopping means to be abutted against the leading edge of the sheet has a surface which is across the surface of the sheet at an acute angle less than 90°.

5. An obliquely traveling sheet correcting device according to claim 1, wherein said stopping means is arranged such that when the sheet swings said stopping means by pushing it, the reaction force which the sheet receives from the stopping means weakens as the leading edge of the sheet causes said stopping means to swing.

6. An obliquely traveling sheet correcting device according to claim 5, wherein the reaction force which said urging means causes said stopping means to act on the sheet is generated by gravity acting on said stopping means.

7. An obliquely traveling sheet correcting device according to claim 1, wherein said urging means includes reaction force switching means for adjusting the reaction force acting on the sheet by said stopping means.

8. An obliquely traveling sheet correcting device according to claim 1, wherein said second sheet conveyer means has a sheet oblique travel correcting action and a sheet curl removing action in cooperation with said stopping means.

9. An obliquely traveling sheet correcting device according to claim 1, wherein said second sheet conveyer means includes a sheet conveyer rotary body and said stopping means is swingable about the center of rotation of said sheet conveyer rotary body.

10. An obliquely traveling sheet correcting device according to claim 9, wherein:

said sheet conveyer rotary body is divided into a plurality of portions each disposed on the same axis;

said stopping means is swingingly supported between the divided portions of said sheet conveyer rotary body; and further comprising an auxiliary free roller, wherein said stopping means is positioned with respect to said sheet conveyer rotary body to permit said sheet conveyer rotary body and said stopping means to independently turn, said auxiliary free roller being disposed between said sheet conveyer rotary body and said stopping means.

11. An obliquely traveling sheet correcting device according to claim 1, wherein a space having a shape corresponding to the shape of a loop which is formed by the sheet by the action of said stopping means is provided on a sheet conveyer passage between said first sheet conveyer means and said second sheet conveyer means.

12. An obliquely traveling sheet correcting device according to claim 1, further comprising a sheet guide having a shape corresponding to the shape of a loop which is formed by the sheet by the action of said stopping means and disposed in the sheet conveying passage between said first sheet conveyer means and said second sheet conveyer means; and a flapper member disposed at a position corresponding to said sheet guide for assisting the formation of the loop of the sheet.

13. An obliquely traveling sheet correcting device according to claim 12, wherein said flapper member is disposed at at least two positions on a line in the direction perpendicular to the sheet conveying direction in correspondence to the width of the sheet conveyed and abutts against at least at both the edges of the sheet being conveyed in the sheet conveying direction.

14. An obliquely traveling sheet correcting device according to claim 1, further comprising a sheet guide having a shape corresponding to the shape of a loop formed by the sheet by the action of said stopping means, said sheet guide positioned between said first sheet conveyer means and said second sheet conveyer means; and an elastic member disposed at a position corresponding to said sheet guide for assisting the formation of the loop of the sheet.

15. An obliquely traveling sheet correcting device according to claim 1 to 14, comprising a plurality of stopping means disposed on a conveyer passage through which the sheet is conveyed.

16. An image forming apparatus, comprising:

first sheet conveyer means for conveying a sheet;

second sheet conveyer means disposed downstream of said first sheet conveyer means for conveying the sheet;

stopping means disposed in the vicinity of said second sheet conveyer means for abutting against the leading edge of the sheet conveyed by said first conveyer means to thereby stop the leading edge of the sheet, said stopping means for swinging between a position of a first attitude where it abuts against the leading edge of the sheet and a second position attitude where it permits the sheet to pass therethrough, wherein said stopping means causes the sheet to form a loop when in the position of the first attitude as the sheet is conveyed by said first sheet conveyor means and is moved to the position of the second attitude by a force from the sheet after the sheet forms the loop, and as said stopping means moves to the position of the second attitude, the leading edge of the sheet stays abutted against said stopping means at least until clamped by said second sheet conveyor means; and urging means for urging said stopping means to the position of the first attitude; and image forming means for forming an image on the conveyed sheet.

17. An image forming apparatus according to claim 16, wherein the abutting surface of said stopping means comprises at least three members to be abutted against the leading edge of the sheet, said members disposed at at least three positions along a line running perpendicular to the sheet conveying direction, and at least one position of the members being disposed at the center of the width of the sheet being conveyed.

18. An image forming apparatus according to claim 16, wherein the abutting surface of said stopping means to be abutted against the leading edge of the sheet is composed of an arc surface having a predetermined radius.

19. An image forming apparatus according to claim 16, wherein when said stopping means is set to the position of the first attitude where it stops the leading edge of the sheet, the abutting surface of said stopping means to be abutted against the leading edge of the sheet has surface which is across the surface of the sheet at an acute angle less than 90°.

20. An image forming apparatus according to claim 16, wherein said stopping means is arranged such that when the sheet swings said stopping means by pushing it, the reaction force which the sheet receives from the stopping means weakens as the leading edge of the sheet causes said stopping means to swing.

21. An image forming apparatus according to claim 20, wherein the reaction force which said urging means causes said stopping means to act on the sheet is generated by gravity acting on said stopping means.

22. An image forming apparatus according to claim 16, wherein said urging means includes reaction force switching means for adjusting the reaction force acting on the sheet by said stopping means.

23. An image forming apparatus according to claim 16, wherein said second sheet conveyer means has a sheet oblique travel correcting action and a sheet curl removing action in cooperation with said stopping means.

24. An image forming apparatus according to claim 16, wherein said second sheet conveyer means includes a sheet conveyer rotary body and said stopping member is swingable about the center of rotation of said sheet conveyer rotary body.

25. An image forming apparatus according to claim 24, wherein:

said sheet conveyer rotary body is divided into a plurality of portions each disposed on the same axis;

said stopping means is swingingly supported between the divided portions of said sheet conveyer rotary body; and further comprising an auxiliary free roller, wherein said stopping means is positioned with respect to said sheet conveyer rotary body to permit said sheet conveyer rotary body and said stopping means to independently turn, said auxiliary free roller being disposed between said sheet conveyer rotary body and said stopping means.

26. An image forming apparatus according to claim 16, wherein a space having a shape corresponding to the shape of a loop which is formed by the sheet by the action of said stopping means is provided on a sheet conveyer passage between said first sheet conveyer means and said second sheet conveyer means.

27. An image forming apparatus according to claim 16, further comprising a sheet guide having a shape corresponding to the shape of a loop which is formed by the sheet by the action of said stopping means and disposed in the sheet conveying passage between said first sheet conveyer means and said second sheet conveyer means; and a flapper member disposed at a position corresponding to said sheet guide for assisting the formation of the loop of the sheet.

28. An image forming apparatus according to claim 27, wherein said flapper member is disposed at at least two positions on a line in the direction perpendicular to the sheet conveying direction in correspondence to the width of the sheet conveyed and abutts against at least at both the edges of the sheet being conveyed in the sheet conveying direction.

29. An image forming apparatus according to claim 16, further comprising a sheet guide having a shape corresponding to the shape of a loop formed by the sheet by the action of said stopping means, said sheet guide positioned between said first sheet conveyer means and said second sheet conveyer means; and an elastic member disposed at a position corresponding to said sheet guide for assisting the formation of the loop of the sheet.

30. An image forming apparatus according to claim 16, further comprising sheet sensing means disposed in the vicinity of and downstream of said stopping means in the sheet conveying direction and upstream of said image forming means in the sheet conveying direction.

31. An image forming apparatus according to claim 30, wherein said stopping means cooperates with said sheet sensing means.

32. An image forming apparatus according to claim 31, wherein a portion of said stopping means also acts as a portion of said sheet sensing means.

33. An image forming apparatus according to claim 16 or claim 30, wherein said second sheet conveyer means includes a image carrier rotary body constituting said image forming means or a transfer rotary body confronting said image carrier rotary body.

34. An obliquely traveling sheet correcting device according to claim 1, wherein said stopping means includes a holding unit for holding the leading edge of the sheet.

35. A sheet conveyer device, comprising:

first conveyer means for conveying a sheet;

second conveyer means disposed downstream of said first conveyer means for conveying the sheet while clamping it; and stopping means movable between a first position where it stops the leading edge of the sheet conveyed by said first conveyer means and a second position where it permits the sheet conveyed by said first conveyer means to pass therethrough, wherein said stopping means causes the sheet to form a loop when in the position of the first attitude as the sheet is conveyed by said first conveyor means and is moved to the position of the second attitude by a force from the sheet after the sheet forms the loop, and as said stopping means moves to the position of the second attitude, the leading edge of the sheet stays abutted against said stopping means at least until clamped by said second conveyor means, and wherein when said stopping means is located at the first position, it abuts the leading edge of the sheet upstream of said second conveyer means.

36. A sheet conveyer device according to claim 35, wherein said second conveyer means includes a pair of rotary bodies for conveying the sheet while clamping it.

37. A sheet conveyer device according to claim 35, wherein said stopping means is turnably supported and is acted upon by gravity such that the stopping means generates torque in a direction for forcing back the leading edge of the sheet conveyed by said first conveyer means.

38. A sheet conveyer device according to claim 37, wherein the action of gravity on said stopping means is such that the more said stopping means is turned as it is pushed by the sheet, the weaker the torque in the direction for forcing back the sheet is made.

39. A sheet conveyer device according to claim 35, wherein said stopping means includes a holding unit for holding the leading edge of the sheet.

40. A sheet conveyer device according to claim 39, wherein said holding unit includes a groove formed to permit the leading edge of the sheet to enter.

41. A sheet conveyer device according to claim 35, wherein further comprising image forming means for forming an image to a sheet conveyed by said second conveyer means.

42. A sheet conveyer device according to claim 35, wherein said stopping means moves from the first position to the second position by being pushed by the sheet conveyed by said first conveyer means.

43. A sheet conveyer device comprising:

a sheet conveyer means for conveying a sheet;

a sheet conveyer roller disposed downstream of said sheet conveyer means for conveying the sheet, wherein said sheet conveyer roller is divided into a plurality of rotary bodies each disposed on a shaft;

a plurality of stopping members rotatably supported on said shaft for abutting against the leading edge of the sheet conveyed by said sheet conveyer means to thereby stop the leading edge of the sheet, wherein each of said stopping members rotates between a first position where it abuts against the leading edge of the sheet and a second position where it permits the sheet to path there through, wherein said plurality of stopping members causes the sheet to form a loop when in the first position as the sheet is conveyed by said sheet conveyor means and is moved to the second position by a force from the sheet after the sheet forms the loop, and as said stopping members move to the second position, the leading edge of the sheet stays abutted against said plurality of stopping members at least until clamped by said sheet conveyor roller, and each of said stopping members is disposed between said rotary bodies;

a connecting member for connecting said plurality of stopping members integrally; and urging means for urging said plurality of stopping members to said first position.

44. A sheet conveyer device according to claim 43, wherein the swinging motion of said plurality of stopping members coincides with one another by said connecting member.

45. A sheet conveyer device according to claim 44, said urging means includes said connecting member and wherein the urging force of said urging means is caused by the gravity of said connecting member.

46. A sheet conveyer device according to claim 43, further comprising image forming means for forming an image to a sheet conveyed by said sheet conveyer roller.

47. A sheet conveyer device according to claim 43, wherein said plurality of stopping members are freely supported on said shaft.

48. A sheet conveyer device according to claim 43, further comprising a second sheet conveyer roller for forming a nip with said sheet conveyer roller to grip the sheet.

* * * * *

UNITED STATES PATENT AND TRADEMARK OFFICE

CERTIFICATE OF CORRECTION

PATENT NO. : 6,011,948

DATED : January 4, 2000

INVENTOR(S): MASAO AMANO, ET AL.

It is certified that error appears in the above-identified patent and that said Letters Patent is hereby corrected as shown below:

COLUMN 5,
Line 64, "inopposing" should read --in opposing--.

COLUMN 7,
Line 27, "are" should read --is--.

COLUMN 8,
Line 7, "operation" should read --operations--.

COLUMN 9,
Line 23, "are" should read --is--.

COLUMN 13,
Line 14, "operation" should read --operations--.

COLUMN 14,
Line 10, "roller" should read --rollers--.

COLUMN 21,
Line 19, "abutts" should read --abuts--.

UNITED STATES PATENT AND TRADEMARK OFFICE

CERTIFICATE OF CORRECTION

PATENT NO. : 6,011,948

DATED : January 4, 2000

INVENTOR(S): MASAO AMANO, ET AL.

It is certified that error appears in the above-identified patent and that said Letters Patent is hereby corrected as shown below:

COLUMN 22,
Line 66, "abutts" should read --abuts--, and "at" (2nd occurrence) should be deleted.

COLUMN 24,
Line 29, "there through," should read --therethrough,--.

Signed and Sealed this

Twentieth Day of February, 2001

*Attest:*

Nicholas P. Godici

NICHOLAS P. GODICI

*Attesting Officer*

*Acting Director of the United States Patent and Trademark Office*